US009766575B2

(12) United States Patent
Ohsugi et al.

(10) Patent No.: US 9,766,575 B2
(45) Date of Patent: Sep. 19, 2017

(54) IMAGE FORMING APPARATUS

(71) Applicants: Tatsuya Ohsugi, Kanagawa (JP); Kenji Sugiura, Kanagawa (JP); Hirokazu Ishii, Tokyo (JP); Hiroyoshi Haga, Kanagawa (JP); Yuuji Wada, Kanagawa (JP); Takehide Mizutani, Tokyo (JP); Naoto Kochi, Kanagawa (JP); Naohiro Kumagai, Kanagawa (JP); Seiichi Kogure, Kanagawa (JP); Junpei Fujita, Kanagawa (JP); Kazuki Yogosawa, Kanagawa (JP)

(72) Inventors: Tatsuya Ohsugi, Kanagawa (JP); Kenji Sugiura, Kanagawa (JP); Hirokazu Ishii, Tokyo (JP); Hiroyoshi Haga, Kanagawa (JP); Yuuji Wada, Kanagawa (JP); Takehide Mizutani, Tokyo (JP); Naoto Kochi, Kanagawa (JP); Naohiro Kumagai, Kanagawa (JP); Seiichi Kogure, Kanagawa (JP); Junpei Fujita, Kanagawa (JP); Kazuki Yogosawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/143,806

(22) Filed: May 2, 2016

(65) Prior Publication Data

US 2016/0334739 A1 Nov. 17, 2016

(30) Foreign Application Priority Data

May 15, 2015 (JP) ..... 2015-100423

(51) Int. Cl.
*G03G 15/16* (2006.01)

(52) U.S. Cl.
CPC ..... *G03G 15/1675* (2013.01); *G03G 15/1605* (2013.01); *G03G 2215/0129* (2013.01)

(58) Field of Classification Search
None
See application file for complete search history.

(56) References Cited

U.S. PATENT DOCUMENTS 5,631,725 A 5/1997 Harasawa et al.
5,822,667 A 10/1998 Hayama et al.
(Continued)

FOREIGN PATENT DOCUMENTS

JP 2005227308 A * 8/2005
JP 2012/083646 4/2012
(Continued)

OTHER PUBLICATIONS

U.S. Appl. No. 14/802,374, filed Jul. 17, 2015, Seiichi Kogure et al.
(Continued)

*Primary Examiner* — Sevan A Aydin
(74) *Attorney, Agent, or Firm* — Oblon, McClelland, Maier & Neustadt, L.L.P.

(57) ABSTRACT

An image forming apparatus, including an image bearer configured to bear a toner image; a transfer device disposed opposing to the image bearer; and a transfer bias power source. The transfer bias power source is configured to output a transfer bias to transfer the toner image onto a recording medium. The transfer bias is a superimposed bias that cyclically alternates between a transfer-directional bias to transfer the toner image from the image bearer onto the recording medium and an opposite-directional bias in an opposite direction of the transfer direction. A ratio of a time period of application of the opposite-directional bias to a total time period of one cycle of the output transfer bias is greater than 50%. The transfer bias power source changes a
(Continued)

value of a direct current voltage in the superimposed bias according to a linear velocity of the image bearer.

20 Claims, 19 Drawing Sheets

(56) References Cited

U.S. PATENT DOCUMENTS

| | | | | |
|---|---|---|---|---|
| 6,282,386 | B1 | 8/2001 | Ishii | |
| 2003/0035658 | A1 | 2/2003 | Ishii | |
| 2004/0033091 | A1* | 2/2004 | Saito | G03G 15/1685 399/313 |
| 2004/0202488 | A1* | 10/2004 | Mashiba | G03G 15/1675 399/66 |
| 2005/0152717 | A1* | 7/2005 | Miyaguchi | G03G 15/08 399/252 |
| 2005/0266324 | A1* | 12/2005 | Kobayashi | G03G 5/14 430/58.05 |
| 2007/0127941 | A1 | 6/2007 | Ishii et al. | |
| 2010/0008687 | A1 | 1/2010 | Ishii | |
| 2010/0329707 | A1* | 12/2010 | Yamada | G03G 15/161 399/44 |
| 2012/0224873 | A1* | 9/2012 | Aoki | G03G 15/161 399/66 |
| 2012/0224879 | A1* | 9/2012 | Fujita | G03G 15/0189 399/94 |
| 2012/0224883 | A1* | 9/2012 | Okano | G03G 21/169 399/101 |
| 2012/0237271 | A1 | 9/2012 | Sengoku et al. | |
| 2012/0308250 | A1 | 12/2012 | Shimizu et al. | |
| 2012/0315058 | A1 | 12/2012 | Shimizu et al. | |
| 2012/0328321 | A1 | 12/2012 | Takeuchi et al. | |
| 2013/0004190 | A1 | 1/2013 | Sengoku et al. | |
| 2013/0011155 | A1 | 1/2013 | Ogiyama et al. | |
| 2013/0121714 | A1 | 5/2013 | Tanaka et al. | |
| 2013/0136468 | A1 | 5/2013 | Shimizu et al. | |
| 2013/0136477 | A1 | 5/2013 | Ogiyama et al. | |
| 2013/0164011 | A1 | 6/2013 | Nakamura et al. | |
| 2013/0236201 | A1 | 9/2013 | Mizutani et al. | |
| 2013/0308968 | A1 | 11/2013 | Tanaka et al. | |
| 2014/0029988 | A1 | 1/2014 | Shimizu et al. | |
| 2014/0079418 | A1 | 3/2014 | Tanaka et al. | |
| 2014/0241744 | A1 | 8/2014 | Ichikawa et al. | |
| 2014/0314435 | A1 | 10/2014 | Kato et al. | |
| 2014/0328603 | A1 | 11/2014 | Mizutani et al. | |
| 2014/0328604 | A1 | 11/2014 | Tanaka et al. | |
| 2015/0212454 | A1 | 7/2015 | Ichikawa et al. | |
| 2015/0378284 | A1 | 12/2015 | Wada et al. | |
| 2016/0033915 | A1 | 2/2016 | Kumagai et al. | |

FOREIGN PATENT DOCUMENTS

| | | |
|---|---|---|
| JP | 2013/127599 | 6/2013 |
| JP | 2013/231936 | 11/2013 |
| JP | 2014/178385 | 9/2014 |
| JP | 2014/194515 | 10/2014 |

OTHER PUBLICATIONS

U.S. Appl. No. 14/822,180, filed Aug. 10, 2015, Naoto Kochi.
U.S. Appl. No. 14/956,707, filed Dec. 2, 2015, Kenji Sugiura et al.
U.S. Appl. No. 14/969,216, filed Dec. 15, 2015, Seiichi Kogure et al.
U.S. Appl. No. 15/073,983, filed Mar. 18, 2016, Tatsuya Ohsugi et al.
U.S. Appl. No. 14/966,398, filed Dec. 11, 2015, Seiichi Kogure et al.
U.S. Appl. No. 15/065,600, filed Mar. 9, 2016, Kenji Sugiura et al.
U.S. Appl. No. 14/962,062, filed Dec. 8, 2015, Yuuji Wada et al.

* cited by examiner

FIG. 6

| INTERMEDIATE TRANSFER BELT | PRENIP AMOUNT | PAPER TYPE | SECONDARY TRANSFER CURRENT [-μA] | | | | | |
|---|---|---|---|---|---|---|---|---|
| | | | 60 | 80 | 100 | 120 | 140 | 160 |
| ELASTIC BELT | 0 mm | THIN | POOR | POOR | POOR | POOR | POOR | POOR |
| | | PLAIN | POOR | POOR | POOR | POOR | POOR | POOR |
| | 1 mm | THIN | POOR | POOR | POOR | POOR | POOR | POOR |
| | | PLAIN | GOOD | FAIR | POOR | POOR | POOR | POOR |
| | 2 mm | THIN | GOOD | FAIR | POOR | POOR | POOR | POOR |
| | | PLAIN | GOOD | GOOD | GOOD | POOR | POOR | POOR |
| | 3 mm | THIN | GOOD | GOOD | FAIR | POOR | POOR | POOR |
| | | PLAIN | GOOD | GOOD | GOOD | GOOD | GOOD | FAIR |
| | 4 mm | THIN | GOOD | GOOD | GOOD | GOOD | FAIR | POOR |
| | | PLAIN | GOOD | GOOD | GOOD | GOOD | GOOD | GOOD |
| | 5 mm | THIN | GOOD | GOOD | GOOD | GOOD | GOOD | FAIR |
| | | PLAIN | GOOD | GOOD | GOOD | GOOD | GOOD | GOOD |
| PI BELT | 0 mm | THIN | FAIR | POOR | POOR | POOR | POOR | POOR |
| | | PLAIN | GOOD | FAIR | POOR | POOR | POOR | POOR |
| | 1 mm | THIN | GOOD | GOOD | POOR | POOR | POOR | POOR |
| | | PLAIN | GOOD | GOOD | GOOD | GOOD | POOR | POOR |
| | 2 mm | THIN | GOOD | GOOD | GOOD | GOOD | POOR | POOR |
| | | PLAIN | GOOD | GOOD | GOOD | GOOD | GOOD | GOOD |
| | 3 mm | THIN | GOOD | GOOD | GOOD | GOOD | GOOD | GOOD |
| | | PLAIN | GOOD | GOOD | GOOD | GOOD | GOOD | GOOD |
| | 4 mm | THIN | GOOD | GOOD | GOOD | GOOD | GOOD | GOOD |
| | | PLAIN | GOOD | GOOD | GOOD | GOOD | GOOD | GOOD |
| | 5 mm | THIN | GOOD | GOOD | GOOD | GOOD | GOOD | GOOD |
| | | PLAIN | GOOD | GOOD | GOOD | GOOD | GOOD | GOOD |

FIG. 17

| Duty [%] | 90 | 70 | 50 | 30 | 10 |
|---|---|---|---|---|---|
| EVALUATION | 5 | 5 | 3 | 1 | 1 |

FIG. 18

| | | CONDITION 1 | CONDITION 2 | CONDITION 3 | CONDITION 4 | CONDITION 5 |
|---|---|---|---|---|---|---|
| SECONDARY TRANSFER BIAS | AC COMPONENT | 100% | 100% | 80% | 80% | 100% |
| | DC COMPONENT | 100% | 80% | 100% | 80% | 70% |
| IMAGE EVALUATION | SOLID (BLUE) | GOOD | GOOD | GOOD | POOR | FAIR |
| | HALF TONE (CYAN) | POOR | GOOD | POOR | GOOD | EXCELLENT |

IMAGE FORMING APPARATUS

CROSS-REFERENCE TO RELATED APPLICATION

This patent application is based on and claims priority pursuant to 35 U.S.C. §119(a) to Japanese Patent Application No. 2015-100423, filed on May 15, 2015, in the Japan Patent Office, the entire disclosure of which is hereby incorporated by reference herein.

BACKGROUND

Technical Field

Exemplary aspects of the present disclosure generally relate to an image forming apparatus, such as a copier, a facsimile machine, a printer, or a multi-functional system including a combination thereof.

Related Art

In an image forming apparatus that employs an electrophotographic method, a belt shaped image bearer bearing an image contacts a transfer device opposed to the image bearer to form a transfer nip as a transfer portion, thereby transferring the image onto a recording sheet in the transfer nip. During the transfer process in the transfer portion, the transfer portion is sometimes supplied with a transfer bias (which is also referred to as a superimposed bias), in which an alternating current (AC) voltage as an alternating current (AC) component is superimposed on a direct current (DC) voltage as a direct current (DC) component. When the linear velocity, which is the moving speed of the image bearer, is lower than a normal linear velocity, the recording sheet takes more time in passing through the transfer nip. In this case, if a value of the applied transfer bias remains the same as at the normal linear velocity, toner is electrically charged for longer time, resulting in the toner being excessively transferred onto the recording sheet.

Hence, for example, a configuration is proposed in which, when the linear velocity of the image bearer is decreased, the amount of the DC voltage in the superimposed voltage is reduced without changing the amount of AC voltage in the superimposed voltage.

SUMMARY

In an aspect of this disclosure, there is provided an improved image forming apparatus, including an image bearer configured to bear a toner image; a transfer device disposed opposing to the image bearer; and a transfer bias power source. The transfer bias power source is configured to output a transfer bias to a transfer portion where the transfer device contacts the image bearer so as to transfer the toner image onto a recording medium. The transfer bias is a superimposed bias, in which an alternating current voltage is superimposed on a direct current voltage, that cyclically alternates between a transfer-directional bias to transfer the toner image from the image bearer onto the recording medium and an opposite-directional bias in an opposite direction of the transfer direction. A ratio of a time period of application of the opposite-directional bias to a total time period of one cycle of the output transfer bias is greater than 50%. The transfer bias power source changes a value of a direct current voltage in the superimposed bias according to a linear velocity of the image bearer.

BRIEF DESCRIPTION OF THE DRAWINGS

The aforementioned and other aspects, features, and advantages of the present disclosure will be better understood by reference to the following detailed description when considered in connection with the accompanying drawings, wherein:

FIG. 3A is a partially enlarged cross-sectional view of an image bearer formed into an elastic belt including a coating layer; FIG. 3B is a partially enlarged cross-sectional view of an image bearer formed into an elastic belt including particles; FIG. 3C is a partially enlarged view of FIG. 3B as seen from above;

FIG. 6 indicates a judgment regarding whether an electrical discharge occurs prior to nipping or not when the amount of offset of a transfer device relative to a belt type image bearer having a different material varies;

FIG. 17 is a table of test results using output waveforms illustrated in FIGS. 15A through 15C;

FIG. 18 is a table of another test results using output waveform illustrated in FIG. 12B;

Figure 1:
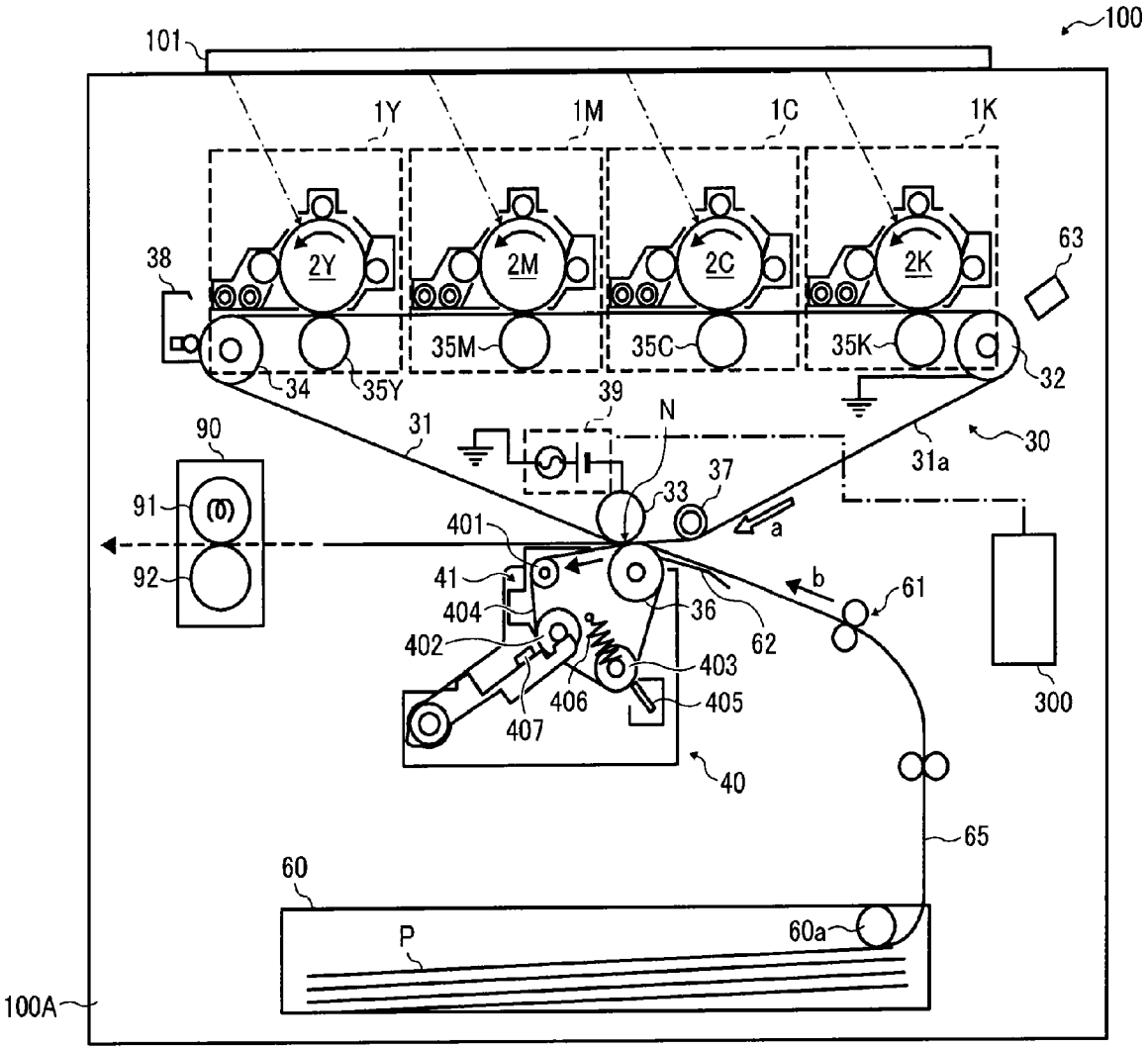
FIG. 1 is a schematic diagram of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity.

However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

With reference to FIG. 1, a description is provided of the image forming apparatus according to an embodiment of the present disclosure. The same reference numerals will be given to constituent elements such as parts and materials having the same functions, and the descriptions thereof will be omitted. In some Figures, portions of configurations are partially omitted to better understand the configurations. It is to be noted that suffixes Y, M, C, and K denote colors yellow, magenta, cyan, and black, respectively. These suffixes may be omitted unless otherwise specified.

With reference to FIG. 1, a description is provided of an electrophotographic color printer as an example of an image forming apparatus 100 according to an embodiment of the present disclosure.

A description is provided of a basic configuration of an image forming apparatus 100, illustrated as an electrophotographic color printer, according to an embodiment of the present disclosure. FIG. 1 is a schematic diagram of the relevant sections of the image forming apparatus 100 according to the present embodiment. As illustrated in FIG. 1, the image forming apparatus 100 includes four image forming units 1Y, 1M, 1C, and 1K for forming toner images, one for each of the colors yellow, magenta, cyan, and black, respectively. It is to be noted that the suffixes Y, M, C, and K denote colors yellow, magenta, cyan, and black, respectively. To simplify the description, the suffixes Y, M, C, and K indicating colors may be omitted herein, unless differentiation of colors is necessary. The image forming apparatus 100 includes a transfer unit 30 as a transfer device, a fixing device 90, a paper cassette 60 to house a recording sheet P as a recording medium, and a controller 300.

The image forming units 1Y, 1M, 1C, and 1K all have the same configuration as all the others, differing only in the color of toner employed as a powder-form developing agent. The image forming units 1Y, 1M, 1C, and 1K are replaced upon reaching their product life cycles. According to the embodiment, the image forming units 1Y, 1M, 1C, and 1K are detachably attachable relative to an apparatus body 100A of the image forming apparatus 100 and replaceable.

Figure 2:
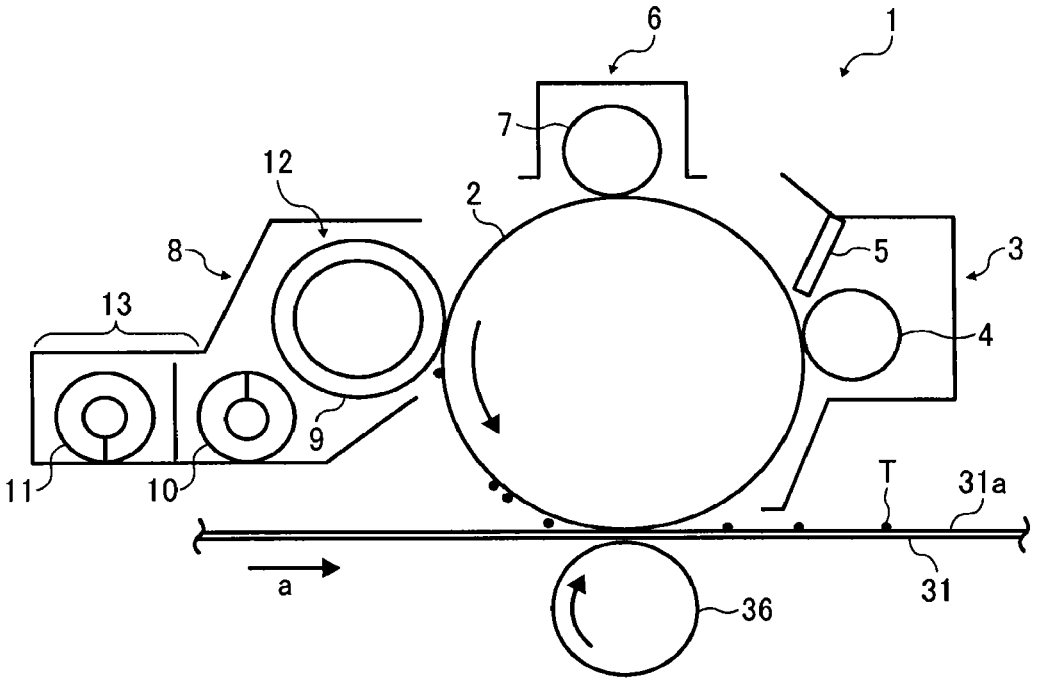
FIG. 2 is a schematic diagram of a toner image forming unit employed in the image forming apparatus of FIG. 1.

FIG. 2 is an enlarged diagram schematically illustrating one of the image forming units 1Y, 1M, 1C, and 1K as a representative example. The image forming units 1Y, 1M, 1C, and 1K all have the same configuration as all the others, differing only in the color of toner employed. Thus, the description is provided without the suffixes Y, M, C, and K indicating colors unless differentiation of the color is necessary.

The image forming unit 1 includes a drum-shaped photoconductor 2 as a latent image bearer, a photoconductor cleaner 3, a static eliminator, a charging device 6, a developing device 8, and so forth. These devices are held in a common casing so that they are detachably installable and replaceable all together relative to the apparatus body 100A, thereby constituting a process cartridge. The image forming unit 1 is replaceable independently.

The photoconductor 2 comprises a drum-shaped base on which an organic photosensitive layer is disposed. The photoconductor 2 is rotated in a clockwise direction indicated by arrow by a driving device such as a motor. The charging device 6 includes a charging roller 7 to which a charging bias is applied. The charging roller 7 contacts or approaches the photoconductor 2 to generate an electrical discharge therebetween, thereby charging uniformly the surface of the photoconductor 2. Instead of using the charging roller 7 or the like that contacts or disposed close to the photoconductor 2, a corona charger or the like that does not contact the photoconductor 2 may be employed.

The uniformly charged surface of the photoconductor 2 by the charging roller 7 is scanned by exposure light such as a light beam projected from the optical writing unit 101, thereby forming an electrostatic latent image for each color on the surface of the photoconductor 2. The electrostatic latent image on the photoconductor 2 is developed with toner of each color by the developing device 8. Accordingly, a visible image, also known as a toner image, is formed. The toner image formed on the photoconductor 2 is transferred primarily onto an intermediate transfer belt 31 formed into an endless loop.

The photoconductor cleaner 3 removes residual toner remaining on the surface of the photoconductor 2 after a primary transfer process, that is, after the photoconductor 2 passes through a primary transfer nip between the intermediate transfer belt 31 and the photoconductor 2. The photoconductor cleaner 3 includes a brush roller 4, which is driven to rotate, and a cleaning blade 5. The cleaning blade 5 contacts the surface of the photoconductor 2. The brush roller 4 rotates and brushes off the residual toner from the surface of the photoconductor 2 while the cleaning blade 5 scraping off the residual toner from the surface. The static eliminator may employ a known static eliminating device and removes residual charge remaining on the photoconductor 2 after the surface thereof is cleaned by the photoconductor cleaner 3. The surface of the photoconductor 2 is initialized in preparation for the subsequent imaging cycle.

The developing device 8 includes a developing portion 12 and a developer conveyor 13. The developing portion 12 includes a developing roller 9 as a developer bearer inside thereof. The developer conveyor 13 stirs and transports the developing agent. The developer conveyor 13 includes a first chamber equipped with a first screw 10 and a second chamber equipped with a second screw 11. The first screw 10 and the second screw 11 are rotatably supported by a casing or the like of the developing device 8. The first screw 10 and the second screw 11 are rotated to deliver the developing agent to the developing roller 9 while circulating the developing agent.

As illustrated in FIG. 1, the optical writing unit 101 for writing a latent image on the photoconductors 2 is disposed above the image forming units 1Y, 1M, 1C, and 1K. Based on image information received from an external device such as a personal computer (PC), the optical writing unit 101 scans optically the photoconductors 2Y, 2M, 2C, and 2K with a light beam projected from a laser diode of the optical writing unit 101. Accordingly, the electrostatic latent images of yellow, magenta, cyan, and black are formed on the photosensitive drums 2Y, 2M, 2C, and 2K, respectively.

Referring back to FIG. 1, a description is provided of the transfer unit 30. The transfer unit 30 is disposed substantially below the image forming units 1Y, 1M, 1C, and 1K. The transfer unit 30 includes the intermediate transfer belt 31 as an image bearer formed into an endless loop and rotated in the clockwise direction indicated by arrow a in the Figure (that is, a direction a of movement of the belt). A direction of rotation of the intermediate transfer belt 31 is referred to as a direction a of movement of the belt.

The secondary transfer unit 30 includes a plurality of rollers: a drive roller 32, a secondary-transfer first roller 33, a cleaning auxiliary roller 34, four primary transfer rollers 35Y, 35M, 35C, and 35K (which may be referred to collectively as primary transfer rollers 35), and a pre-transfer roller 37 as a depressing device. The primary transfer rollers 35Y, 35M, 35C, and 35K are disposed opposite the photosensitive drums 2Y, 2M, 2C, and 2K, respectively, via the intermediate transfer belt 31. The transfer unit 30 is detachably attachable (replaceable) relative to the apparatus body 100A.

The intermediate transfer belt 31 is looped around and stretched taut between the plurality of rollers. i.e., the drive roller 32, the secondary-transfer first roller 33, the cleaning auxiliary roller 34, the four primary transfer rollers 35Y, 35M, 35C, and 35K, and the pre-transfer roller 37. The drive roller 32 is rotated in the clockwise direction by a motor or the like, and rotation of the drive roller 32 enables the intermediate transfer belt 31 to rotate in the same direction. In the transfer unit 30, the intermediate transfer belt 31 is wound around the plurality of rollers, thereby delivering the recording sheet P.

The intermediate transfer belt 31 according to the present embodiment is an endless looped belt having at least a base layer 310, an elastic layer 311, and a surface coating layer 312. In some embodiments, a belt including a laminate of the base layer 310 and the elastic layer 311 with a large numbers of particles 313 dispersed in the elastic layer 311 can be used as the intermediate transfer belt 31, as illustrated in FIG. 3B. While a portion of the particles 313 projects from the elastic layer 311, the particles 313 are arranged concentratedly in a belt surface direction as illustrated in FIG. 3C. With these particles 313, an uneven surface of the belt with multiple bumps is formed on the front surface 31*a* of the intermediate transfer belt 31.

Figure 3A:
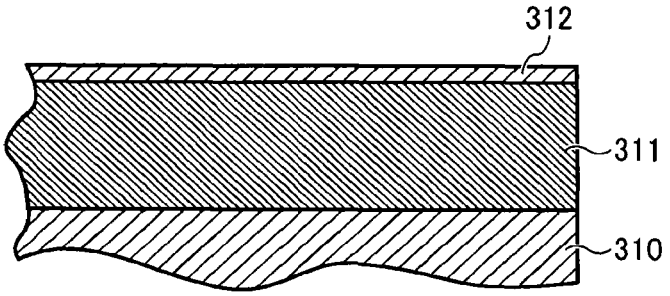
FIGS. 3A, 3B, and 3C are views of an image bearer formed into an endless loop.
Figure 3B:
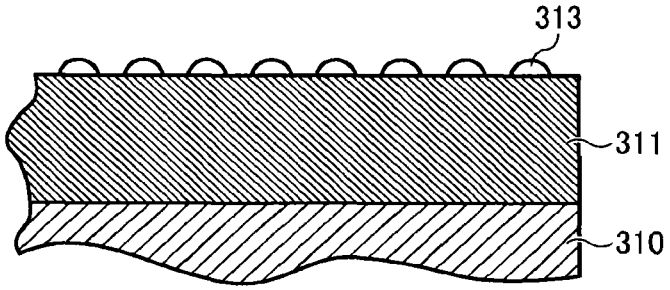
Figure 3C:
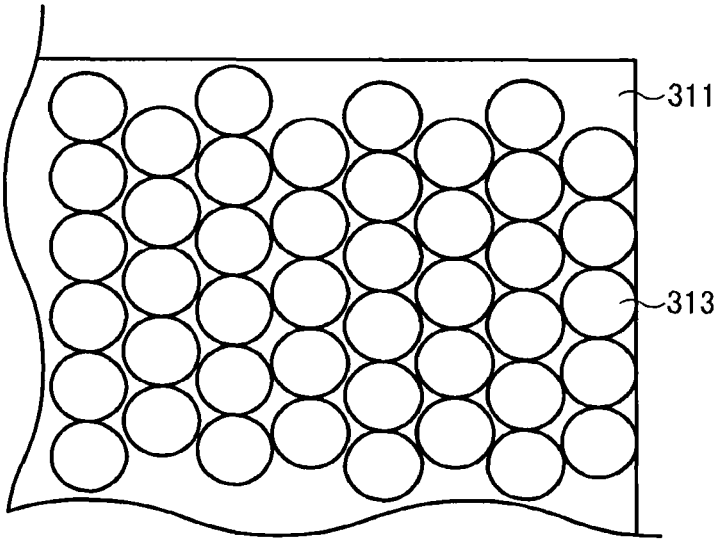

As illustrated in FIGS. 3A and B, the intermediate transfer belt 31 includes the base layer 310 and the elastic layer 311. The base layer 310 formed into an endless looped belt is formed of a material having a high stiffness, but having some flexibility. The elastic layer 311 disposed on the front surface of the base layer 310 is formed of an elastic material with high elasticity.

Examples of materials for the base layer 310 include, but are not limited to, a resin in which an electrical resistance adjusting material made of a filler or an additive is dispersed to adjust electrical resistance. Examples of the resin constituting the base layer include, but are not limited to, fluorine-based resins such as ethylene tetrafluoroethylene copolymers (ETFE) and polyvinylidene fluoride (PVDF) in terms of flame retardancy, and polyimide resins or polyamide-imide resins. In terms of mechanical strength (high elasticity) and heat resistance, specifically, polyimide resins or polyamide-imide resins are more preferable.

Examples of the electrical resistance adjusting materials dispersed in the resin include, but are not limited to, metal oxides, carbon blacks, ion conductive materials, and conductive polymers. Examples of metal oxides include, but are not limited to, zinc oxide, tin oxide, titanium oxide, zirconium oxide, aluminum oxide, and silicon oxide. In order to enhance dispersiveness, surface treatment may be applied to metal oxides in advance. Examples of carbon blacks include, but are not limited to, ketchen black, furnace black, acetylene black, thermal black, and gas black. Examples of ion conductive materials include, but are not limited to, tetraalkylammonium salt, trialkyl benzyl ammonium salt, alkylsulfonate, and alkylbenzene sulfonate. Examples of ion conductive materials include, but are not limited to, tetraalkylammonium salt, trialkyl benzyl ammonium salt, alkylsulfonate, alkylbenzene sulfonate, alkylsulfate, glycerol esters of fatty acid, sorbitan fatty acid ester, polyoxyethylene alkylamine, polyoxyethylene aliphatic alcohol ester, alkylbetaine, and lithium perchlorate. Two or more ion conductive materials can be mixed. It is to be noted that electrical resistance adjusting materials are not limited to the above-mentioned materials.

A dispersion auxiliary agent, a reinforcing material, a lubricating material, a heat conduction material, an antioxidant, and so forth may be added to a coating liquid which is a precursor for the base layer 310, as needed. The coating solution is a liquid resin before curing in which electrical resistance adjusting materials are dispersed. An amount of the electrical resistance adjusting materials to be dispersed in the base layer 310 of a seamless belt, i.e., the intermediate transfer belt 31 is preferably in a range from $1\times10^{8}$ to $1\times10^{13}$ Ω/sq in surface resistivity, and in a range from $1\times10^{6}$ to $10^{12}$ Ω·cm in volume resistivity. In terms of mechanical strength, an amount of the electrical resistance adjusting material to be added is determined such that the formed film is not fragile and does not crack easily. Preferably, a coating liquid, in which a mixture of the resin component (for example, a polyimide resin precursor and a polyamide-imide resin precursor) and the electrical resistance adjusting material are adjusted properly, is used to manufacture a seamless belt (i.e., the intermediate transfer belt) in which the electrical characteristics (i.e., the surface resistivity and the volume resistivity) and the mechanical strength are well balanced. The content of the electrical resistance adjusting material in the coating liquid when using carbon black is in a range from 10% through 25% by weight or preferably, from 15% through 20% by weight relative to the solid content. The content of the electrical resistance adjusting material in the coating liquid when using metal oxides is approximately 150% by weight or more preferably, in a range from 10% through 30% by weight relative to the solid content. If the content of the electrical resistance adjusting material is less than the above-described respective range, a desired effect is not achieved. If the content of the electrical resistance adjusting material is greater than the above-described respective range, the mechanical strength of the intermediate transfer belt (seamless belt) 61 drops, which is undesirable in actual use.

The thickness of the base layer 310 is not limited to a particular thickness and can be selected as needed. The thickness of the base layer 310 is preferably in a range from 30 μm to 150 μm, more preferably in a range from 40 μm to 120 μm, even more preferably, in a range from 50 μm to 80 μm. The base layer 310 having a thickness of less than 30 μm cracks and gets torn easily. The base layer 310 having a thickness of greater than 150 μm cracks when it is bent. By contrast, if the thickness of the base layer 310 is in the above-described respective range, the durability is enhanced.

In order to increase the stability of traveling of the intermediate transfer belt 31, preferably, the thickness of the base layer 310 is uniform as much as possible. An adjustment method to adjust the thickness of the base layer 310 is not limited to a particular method, and can be selected as needed. For example, the thickness of the base layer can be measured using a contact-type or an eddy-current thickness meter or a scanning electron microscope (SEM) which measures a cross-section of the film.

As described above, the elastic layer 311 of the intermediate transfer belt 31 includes an uneven surface formed with the particles 313 dispersed in the elastic layer 311. Examples of elastic materials for the elastic layer 311 include, but are not limited to, generally-used resins, elastomers, and rubbers. Preferably, elastic materials having good elasticity, such as elastomer materials and rubber materials, are used. Examples of the elastomer materials include, but are not limited to, polyesters, polyamides, polyethers, polyurethanes, polyolefins, polystyrenes, polyacrylics, polydiens, silicone-modified polycarbonates, and thermoplastic elastomers such as fluorine-containing copolymers. Alternatively, thermoplastic elastomer, such as fluorine-based copolymer thermoplastic elastomer, may be employed. Examples of thermosetting resins include, but are not limited to, polyurethane resins, silicone-modified epoxy resins, and silicone modified acrylic resins. Examples of rubber materials include, but are not limited to isoprene rubbers, styrene rubbers, butadiene rubbers, nitrile rubbers, ethylene-propylene rubbers, butyl rubbers, silicone rubbers, chloroprene rubbers, and acrylic rubbers. Examples of rubber materials include, but are not limited to, chlorosulfonated polyethylenes, fluorocarbon rubbers, urethane rubbers, and hydrin rubbers. A material having desired characteristics can be selected from the above-described materials. In particular, in order to accommodate a recording sheet with an uneven surface such as Leathac (registered trademark), soft materials are preferable. Because the particles 313 are dispersed, thermosetting materials are more preferable than thermoplastic materials. The thermosetting materials have a good adhesion property relative to resin particles due to an effect of a functional group contributing to the curing reaction, thereby fixating reliably. For the same reason, vulcanized rubbers are also preferable.

In terms of ozone resistance, softness, adhesion properties relative to the particles, application of flame retardancy, environmental stability, and so forth, acrylic rubbers are most preferable among elastic materials for forming the elastic layer 311. Acrylic rubbers are not limited to a specific product. Commercially-available acrylic rubbers can be used. An acrylic rubber of carboxyl group crosslinking type is preferable since the acrylic rubber of the carboxyl group crosslinking type among other cross linking types (e.g., an epoxy group, an active chlorine group, and a carboxyl group) provides good rubber physical properties (specifically, the compression set) and good workability. Preferably, amine compounds are used as crosslinking agents for the acrylic rubber of the carboxyl group crosslinking type. More preferably, multivalent amine compounds are used. Examples of the amine compounds include, but are not limited to, aliphatic multivalent amine crosslinking agents and aromatic multivalent amine crosslinking agents. Furthermore, examples of the aliphatic multivalent amine crosslinking agents include, but are not limited to, hexamethylenediamine, hexamethylenediamine carbamate, and N,N-dicinnamylidene-1,6-hexanediamine. Examples of the aromatic multivalent amine crosslinking agents include, but are not limited to, 4,4'-methylenedianiline, m-phenylenediamine, 4,4'-diaminodiphenyl ether, 3,4'-diaminodiphenyl ether, 4,4'-(m-phenylenediisopropylidene) dianiline, 4,4'-(p-phenylenediisopropylidene) dianiline, 2,2'-bis[4-(4-aminophenoxy)phenyl]propane, 4,4'-diaminobenzanilide, 4,4'-bis(4-aminophenoxy)biphenyl, m-xylylenediamine, p-xylylenediamine, 1,3,5-benzenetriamine, and 1,3,5-benzenetriaminomethyl.

The amount of the crosslinking agent is, preferably, in a range from 0.05 through 20 parts by weight, more preferably, from 0.1 through 5 parts by weight, relative to 100 parts by weight of the acrylic rubber. An insufficient amount of the crosslinking agent causes failure in crosslinking, hence complicating efforts to maintain the shape of crosslinked products. By contrast, too much crosslinking agent causes crosslinked products to be too stiff, hence degrading elasticity as a crosslinking rubber.

In order to enhance a cross-linking reaction, a crosslinking promoter may be mixed in the acrylic rubber employed for the elastic layer 311. The type of crosslinking promoter is not limited particularly. However, it is preferable that the crosslinking promoter can be used with the above-described multivalent amine crosslinking agents. Such crosslinking promoters include, but are not limited to, guanidino compounds, imidazole compounds, quaternary onium salts, tertiary phosphine compounds, and weak acid alkali metal salts. Examples of the guanidino compounds include, but are not limited to, 1,3-diphenylguanidine, and 1,3-di-o-tolylguanidine. Examples of the imidazole compounds include, but are not limited to, 2-methylimidazole and 2-phenylimidazole. Examples of the quaternary onium salts include, but are not limited to, tetra-n-butylammonium bromide and octadecyltri-n-butylammonium bromide. Examples of the multivalent tertiary amine compounds include, but are not limited to, triethylenediamine and 1,8-diazabicyclo[5.4.0]undec-7-ene (DBU). Examples of the tertiary phosphines include, but are not limited to, triphenylphosphine and tri(p-tolyl)phosphine. Examples of the weak acid alkali metal salts include, but are not limited to, phosphates such as sodium and potassium, inorganic weak acid salts such as carbonate or stearic acid salt, and organic weak acid salts such as lauric acid salt.

The amount of the crosslinking promoter is, preferably, in a range from 0.1 through 20 parts by weight, more preferably, from 0.3 through 10 parts by weight, relative to 100 parts by weight of the acrylic rubber. Too much crosslinking promoter causes undesirable acceleration of crosslinking during crosslinking, generation of bloom of the crosslinking promoter on the surface of crosslinked products, and hardening of the crosslinked products. In contrast, an insufficient amount of the crosslinking agent causes degradation of the tensile strength of the crosslinked products and a significant elongation change or a significant change in the tensile strength after heat load.

The acrylic rubber composition of the present disclosure can be prepared by an appropriate mixing procedure such as roll mixing, Banbury mixing, screw mixing, and solution mixing. The order in which the ingredients are mixed is not particularly limited. However, it is preferable that ingredients that are not easily reacted or decomposed when heated are first mixed thoroughly, and thereafter, ingredients that are easily reacted or decomposed when heated, such as a crosslinking agent, are mixed together in a short period of time at a temperature at which the crosslinking agent is neither reacted not decomposed.

When heated, the acrylic rubber serves as a crosslinked product. The heating temperature is preferably in a range of 130° C. through 220° C., more preferably, 140° C. through 200° C. The crosslinking time period is preferably in a range of 30 seconds through hours. The heating methods can be chosen from those which are used for crosslinking rubber compositions, such as press heating, steam heating, oven heating, and hot-air heating. In order to reliably crosslink the inside of the crosslinked product, post crosslinking may be additionally carried out after crosslinking is carried out once. The post crosslinking time period varies depending on the heating method, the crosslinking temperature and the shape of crosslinked product, but is carried out preferably for 1 through 48 hours. The heating method and the heating temperature may be appropriately chosen. Electrical resistance adjusting agents for adjustment of electrical characteristics and flame retardants to achieve flame retardancy may be added to the selected materials. Furthermore, antioxidants, reinforcing agents, fillers, and crosslinking promoters may be added as needed. The electrical resistance adjusting agents to adjust electrical resistance can be selected from the above-described materials. However, since the carbon blacks and the metal oxides impair flexibility, it is preferable to minimize the amount of use. Ion conductive materials and conductive high polymers are also effective. Alternatively, these materials can be used in combination.

Preferably, various types of perchlorates and ionic liquids in an amount from about 0.01 parts by weight through 3 parts by weight are added, based on 100 parts by weight of rubber. With the ion conductive material in an amount 0.01 parts by weight or less, the resistivity cannot be reduced effectively. However, with the ion conductive material in an amount 3 parts by weight or more, it is highly possible that the conductive material blooms or bleeds to the belt surface.

The electrical resistance adjusting material to be added is in such an amount that the surface resistivity of the elastic layer 311 is, preferably, in a range from $1\times10^{8}$ Ω/sq to $1\times10^{13}$ Ω/sq, and the volume resistivity of the elastic layer 311 is, preferably, in a range from $1\times10^{6}$ Ω·cm to $1\times10^{12}$ Ω·cm. In order to obtain high toner transferability relative to an uneven surface of a recording sheet as is desired in image forming apparatuses using electrophotography in recent years, it is preferable to adjust a micro rubber hardness of the elastic layer 311 to 35 or less under the condition 23° C., 50% RH. In measurement of Martens hardness and Vickers hardness, which are a so-called micro-hardness, a shallow area of a measurement target in a bulk direction, that is, the hardness of only a limited area near the surface is measured. Thus, deformation capability of the entire belt cannot be evaluated. Consequently, for example, in a case in which a soft material is used for the uppermost layer of the intermediate transfer belt 31 with a relatively low deformation capability as a whole, the micro-hardness decreases. In such a configuration, the intermediate transfer belt 31 with a low deformation capability does not conform to the surface condition of the uneven surface of the recording sheet, thereby impairing the desired transferability relative to the uneven surface of the recording sheet. In view of the above, preferably, the micro-rubber hardness, which allows the evaluation of the deformation capability of the entire intermediate transfer belt 31, is measured to evaluate the hardness of the intermediate transfer belt 31.

The layer thickness of the elastic layer 311 is, preferably, in a range from 200 μm to 2 mm, more preferably, 400 μm to 1000 μm. The layer thickness less than 200 μm hinders deformation of the belt in accordance with the roughness (surface condition) of the recording sheet and a transfer-pressure reduction effect. By contrast, the layer thickness greater than 2 mm causes the elastic layer 311 to sag easily due to its own weight, resulting in unstable movement of the intermediate transfer belt 31 and damage to the intermediate transfer belt 31 looped around rollers. The layer thickness can be measured by observing the cross-section of the elastic layer using a scanning electron microscope (SEM), for example.

The surface coating layer 312 of the intermediate transfer belt 31 is a smooth layer that covers the surface of the elastic layer 311. Any material can be used for the surface coating layer 312. However, materials that can enhance the transferability of the secondary transfer through reducing the adhesion force of the toner onto the front surface 31*a* of the intermediate transfer belt 31 are generally used. Examples of materials used for the coating layer include, but are not limited to, polyurethane resin, polyester resin, epoxy resin, and combinations of two or more of the above-described materials. Alternatively, a material that reduces surface energy to improve lubricating property, such as fluorocarbon resin grains, fluorine compound grains with or without the grain size being varied may be used alone or in combination. The surface coating layer may also be a fluorine-containing layer formed by thermally treating a fluorine-containing rubber, thereby reducing surface energy of the layer. However, these materials are not limited thereto.

In order to adjust resistance, each of the base layer 310, the elastic layer 311, and the surface coating layer 312 may be formed of metal powder such as carbon black, graphite, aluminum, and nickel, conductive metal oxides, or the like. However, these materials are not limited thereto.

A lubricant may be applied to the front surface 31*a* of the intermediate transfer belt 31 to protect the front surface 31*a* of the intermediate transfer belt 31 depending on the material of the toner and the intermediate transfer belt employed and the surface friction coefficient of the intermediate transfer belt 31. The materials of the lubricant includes zinc stearate. A brush roller of a lubricant applicator contacts and scrapes a block (solid) luburicant such as a block of zinc stearate while rotating. The lubricant in powder form thus obtained is applied to the surface 31*a* of the intermediate transfer belt 31.

The particle 313 to be dispersed in the elastic material of the elastic layer 311 is a spherical resin particle having an average particle diameter of equal to or less than 100 μm and are insoluble in an organic solvent. Furthermore, the 3% thermal decomposition temperature of these resin particles is equal to or greater than 200° C. The resin material of the particle 313 is not particularly limited, but may include acrylic resins, melamine resins, polyamide resins, polyester resins, silicone resins, fluorocarbon resins, and rubbers. Alternatively, in some embodiments, surface processing with different material is applied to the surface of the particle made of resin materials. A surface of a spherical mother particle made of rubber may be coated with a hard resin. Furthermore, the mother particle may be hollow or porous.

Among such resins mentioned above, the silicone resin particles are most preferred because the silicone resin particles provide good slidability, separability relative to toner, and wear and abrasion resistance. Preferably, the spherical resin particles are prepared through a polymerization process. The more spherical the particle, the more preferred. Preferably, the volume average particle diameter of the particle 313 is in a range from 1.0 μm to 5.0 μm, and the particle dispersion is monodisperse with a sharp distribution. The monodisperse particle is not a particle with a single particle diameter. The monodisperse particle is a particle having a sharp particle size distribution. More specifically, the distribution width of the particle is equal to or less than ±(Average particle diameter×0.5 μm). With the particle diameter of the particle 313 less than 1.0 μm, enhancement of transfer performance by the particle 313 cannot be achieved sufficiently. By contrast, with the particle diameter greater than 5.0 μm, the space between the particles increases, which results in an increase in the surface roughness of the intermediate transfer belt 31. In this configuration, toner is not transferred well, and the intermediate transfer belt 31 cannot be cleaned well. In general, the particle 313 made of resin material has a relatively high insulation property. Thus, if the particle diameter is too large, accumulation of electrical charges of the particle diameter 313 during continuous printing causes image defect easily.

Either commercially-available products or laboratory-derived products may be used as the particle 313. The thus-obtained particle 313 is directly applied to the elastic layer 311 and evened out, thereby evenly distributing the particle 313 with ease. With this configuration, an overlap of the particles 313 in the belt thickness direction is reduced, if not prevented entirely. Preferably, the cross-sectional diameter of the plurality of particles 313 in the surface direction of the elastic layer 311 is as uniform as possible. More specifically, the distribution width thereof is equal to or less than ±(Average particle diameter×0.5 μm). For this reason, preferably, powder including particles with a small particle diameter distribution is used as the particles 313. If the particles 313 having a specific particle diameter can be applied to the elastic layer 311 selectively, it is possible to use particles having a relatively large particle diameter distribution. It is to be noted that timing at which the particles 313 are applied to the surface of the elastic layer 311 is not particularly limited. The particles 313 can be applied before or after crosslinking of the elastic material of the elastic layer 311.

Preferably, a projected area ratio of a portion of the elastic layer 311 having the particles 313 relative to the elastic layer 311 with its surface being exposed is equal to or greater than 60% in the surface direction of the elastic layer 311. In a case in which the projected area ratio is less than 60%, the frequency of direct contact between toner and the pure surface of the elastic layer 313 increases, thereby degrading transferability of toner, cleanability of the belt surface from which toner is removed, and filming resistance. In some embodiments, a belt without the particles 313 dispersed in the elastic layer 311 can be used as the intermediate transfer belt 31.

The intermediate transfer belt 31 is interposed between the primary transfer rollers 35Y, 35M, 35C, and 35K, and photoconductors 2Y, 2M, 2C, and 2K, thereby forming primary transfer nips as transfer sections for each color between the front surface or the image bearing surface of the inter mediate transfer belt 31 and the photoconductors 2Y, 2M, 2C, and 2K. A primary transfer bias is applied to the primary transfer rollers 35Y, 35M, 35C, and 35K by a well-known transfer bias power source. Accordingly, a primary transfer electric field is formed between the primary transfer rollers 35Y, 35M, 35C, and 35K, and the toner images of yellow, magenta, cyan, and black formed on the photoconductors 2Y, 2M, 2C, and 2K.

An yellow toner image formed on the photoconductor 2Y enters the primary transfer nip for yellow as the photoconductor 2Y rotates. Subsequently, the yellow toner image is primarily transferred from the photoconductor 2Y to the intermediate transfer belt 31 by the transfer electric field and the nip pressure. The intermediate transfer belt 31, on which the yellow toner image has been transferred, passes sequentially through the primary transfer nips of magenta, cyan, and black. Subsequently, a magenta toner image, a cyan toner image, and a black toner image on the photoconductors 2M, 2C, and 2K, respectively, are superimposed on the yellow toner image which has been transferred on the intermediate transfer belt 31, one atop the other in the primary transfer process. Accordingly, a composite toner image, in which the toner images of four different colors are superimposed on one atop the other, is formed on the surface of the intermediate transfer belt 31 in the primary transfer process. According to the present embodiment, roller-type primary transfer devices, that is, the primary transfer rollers 35Y, 35M, 35C, and 35K, are employed as primary transfer devices. Alternatively, a transfer charger and a brush-type transfer device may be employed as the primary transfer device. The present embodiment was described assuming that a full-color image, in which toner images of four different colors are superimposed one atop the other, is formed. Alternatively, a single-color toner image with any one of an yellow toner, a magenta toner, a cyan toner, and a black toner, or a toner image with at least two of these color toner may be formed to be transferred onto the intermediate transfer belt 31 in the primary image forming process.

Outside the loop formed by the intermediate transfer belt 31, a secondary transfer unit 41 is disposed. The secondary transfer unit 41 includes a secondary transfer belt 404 as an image bearer and also as a secondary transfer device. The intermediate transfer belt 31 is interposed between the secondary-transfer first roller 33 and the secondary-transfer second roller 36, thereby forming a secondary transfer nip N at which the front surface 31*a* of the intermediate transfer belt 31 contacts the secondary transfer belt 404. The secondary-transfer first roller 33 is also called an opposed roller opposing the secondary transfer belt 404 via the intermediate transfer belt 31.

A secondary transfer bias is applied to the secondary-transfer first roller 33 by the power source 39. With this configuration, a secondary-transfer electrical field is formed between the secondary-transfer first roller 33 and the secondary transfer belt 404 so that the toner having a negative polarity is moved electrostatically from the secondary-transfer first roller 33 to the secondary transfer belt 404.

The first support assembly 40 detachably supports the secondary transfer unit 41. The secondary transfer unit 41 is replaceable independently. The secondary transfer unit 41 includes a secondary-transfer second roller 36 as a secondary transfer device opposed to the secondary-transfer first roller 33 via the intermediate transfer belt 31. The secondary transfer unit 41 includes three rollers 401, 402, and 403, the secondary-transfer second roller 36, and the secondary transfer belt 404 looped around the three rollers 401, 402, and 403. The secondary transfer unit 41 is a belt conveyor unit in which the secondary transfer belt 404 is an endless looped belt as a transfer device, and is wound around the plurality of rollers, i.e., the secondary-transfer second roller 36, and the rollers 401, 402, and 403. The secondary-transfer second roller 36 can also be referred to as a nip forming roller.

The secondary-transfer second roller 36 secondarily transfers the toner image on the front surface 31*a* of the intermediate transfer belt 31 onto the recording sheet P. The secondary-transfer second roller 36 is disposed inside the belt loop of the secondary transfer belt 404, opposing the secondary-transfer first roller 33. The intermediate transfer belt 31 and the secondary transfer belt 404 are interposed between the secondary-transfer second roller 36 and the secondary-transfer first roller 33. The secondary-transfer second roller 36 is biased against the intermediate transfer belt 404 so as to pressingly contact the intermediate transfer belt 31, thereby forming the secondary transfer nip N between the intermediate transfer belt 31 and the secondary transfer belt 404.

The material for the secondary transfer belt 404 may be selected from resin such as polyimide (PI) resin, polyamide imide (PAI) resin, and polyvinylidene (PVDF) resin. The secondary transfer belt 404 are not limited to those described above, but may employ a belt made of an elastic material. According to the present embodiment, a belt made of polyimide resin (PI), having a thickness of 80 μm is employed.

The roller 401 is to strip the recording sheet P electrostatically absorbed to the secondary transfer belt 404 from the secondary transfer belt 404 by self stripping. The roller 403 serves as a tension roller that presses the secondary transfer belt 404 from the inside of the loop of the secondary transfer belt 404 towards the outside by a tension spring 406 as a biasing device. It is to be noted that a cleaning blade 405 is disposed outside of the loop of the secondary transfer belt 404, contacting the roller 403 to remove toner with a cleaning blade 405 that contacts the front surface (outer circumferential surface) of the secondary transfer belt 404. Hence, the roller 403 serves as a cleaning blade opposed roller.

In the secondary transfer unit 41, a pattern sensor 407 as a density detector is disposed outside of the loop of the secondary transfer belt 404, facing the roller 402. The pattern sensor 407 adjusts an image density.

The secondary transfer unit 41 that employs a belt scheme has advantageous effects from the viewpoint of reliably separating the recording sheet P from the intermediate transfer belt 31. This is because a greater attracting force from the secondary transfer belt 404 acts on the recording sheet P than the intermediate transfer belt 31 when the recording sheet P passes through the secondary transfer nip N. Therefore, the image forming device according to the present embodiment that employs the belt scheme accommodate a separation of thin paper as well.

According to the present embodiment, a bias (a secondary transfer bias) is applied to the secondary-transfer first roller 33 or to the secondary-transfer second roller 36 from the power source 39. In a case in which the secondary transfer bias is applied to the secondary-transfer second roller 36, the secondary transfer bias having a polarity opposite to that of the toner is applied thereto. In a case in which the secondary transfer bias is applied to the secondary-transfer first roller 33, the secondary transfer bias having the same polarity as that of the toner is applied thereto.

In the present embodiment, the power source 39 outputs the secondary transfer bias to transfer a toner image onto the recording sheet Pin the secondary transfer nip N. The secondary transfer bias output from the power source 39 to the secondary-transfer first roller 33 includes two types: a direct current (DC) voltage as a direct current (DC) component and a superimposed bias, in which an alternating current (AC) voltage as an alternating current (AC) component is superimposed on the DC voltage as a DC component.

More particularly, the power source 39 alternates a voltage in a transfer direction (a transfer-directional voltage) to transfer a toner image from the image bearer to the recording sheet and a voltage in a return direction (a return-directional voltage, or an opposite-directional voltage) having a polarity opposite that of the voltage in the transfer direction when supplying a voltage to the secondary-transfer first roller 33 to transfer a toner image at least on the image bearer onto the recording sheet P. In this case, a ratio of a time period for applying the return-directional bias to a total time period of one cycle of the voltage output from the power source 39 is greater than 50%. A description is provided later of the secondary transfer bias according to an embodiment of the present disclosure.

As illustrated in FIG. 1, the paper cassette 60 storing a sheaf of recording sheets P such as various types of paper sheets and resin sheets is disposed below the transfer unit 41. The paper cassette 60 is equipped with a feed roller 60*a* to contact the top sheet of recording sheet P in the paper cassette 60. As the feed roller 60*a* is rotated at a predetermined speed, the feed roller 60*a* picks up and sends the top sheet of the recording sheets P to a delivery path 65 formed between the paper cassette 60 and the secondary transfer nip N. Through the delivery path, a pair of conveyance rollers, a pair of registration rollers 61, and a lower guide 62 is disposed. The pair of registration rollers 61 starts to rotate again to feed the recording sheet P, which has been fed from the paper cassette 60, to the secondary transfer nip N in appropriate timing such that the recording sheet P is aligned with the composite toner image formed on the front surface 31*a* of the intermediate transfer belt 31 in the secondary transfer nip N.

In the secondary transfer nip N, the composite toner image on the intermediate transfer belt 31 is transferred onto the recording sheet P by the secondary transfer electric field and the nip pressure applied thereto in the secondary transfer nip N, thereby forming a full color image on the front surface 31*a* of the white recording sheet P. After the intermediate transfer belt 31 passes through the secondary transfer nip N, the toner residue not having been transferred onto the recording sheet P remains on the intermediate transfer belt 31. The residual toner is removed from the intermediate transfer belt 31 by the belt cleaning device 38 which contacts the front surface 31*a* of the intermediate transfer belt 31. The cleaning auxiliary roller 34 disposed inside the loop formed by the intermediate transfer belt 31 supports the cleaning operation performed by the belt cleaning device 38.

The fixing device 90 is disposed downstream from the secondary transfer nip N in the direction b of conveyance of the recording sheet P. After the secondary transfer, the recording sheet P, onto which the composite color toner image is transferred, is transported to the fixing device 90. The fixing device 90 includes a fixing roller 91 including a heat source inside thereof and a pressing roller 92. The fixing roller 91 and the pressing roller 92 contact to form the fixing nip where heat and pressure are applied. The composite toner image is softened and fixed on the recording sheet P as the recording sheet P passes through the fixing nip. After the toner image is fixed to the recording sheet P, the recording sheet P is output from the fixing device 90. Subsequently, the recording sheet P is delivered outside the image forming apparatus 100.

In such a configuration, the process linear velocity of image forming apparatus 100, that is, the linear velocity (moving speed) E1 of each of the photoconductors 2Y, 2M, 2C, and 2K and the linear velocity E2 of the intermediate transfer belt 31 are configured to be the same. These linear velocities E1 and E2 increases or reduces from a reference speed Ea as a predetermined speed. For example, the image forming apparatus 100 is set to the reference speed Ea for printing an image with a reference quality, set to +E1 and +E2 higher than the reference speed Ea for printing an image with speed priority, and set to −E1 and −E2 lower than the reference speed Ea for printing a higher quality image than a reference quality.

According to the present embodiment, a bias (a secondary transfer bias) is applied to the secondary-transfer first roller 33 from the power source 39. According to the present embodiment, the secondary-transfer first roller 33, to which the power source 39 applies a bias, is sometimes called a repulsive roller because a transfer bias having a negative polarity is applied to a negative-charged toner so that the toner applied with the transfer bias is transferred with a repulsive force. The secondary-transfer first roller 33 is a foamed roller, such as a sponge roller. The second transfer bias output from the power source 39 may be applied to the secondary-transfer second roller 36 instead of to the secondary-transfer first roller 33.

In a case in which the secondary transfer bias is applied to the secondary-transfer second roller 36, the secondary transfer bias having a polarity opposite that of the toner is applied thereto. In a case in which the secondary transfer bias is applied to the secondary-transfer first roller 33, the secondary transfer bias having the same polarity as that of the toner is applied thereto.

Figure 4A:
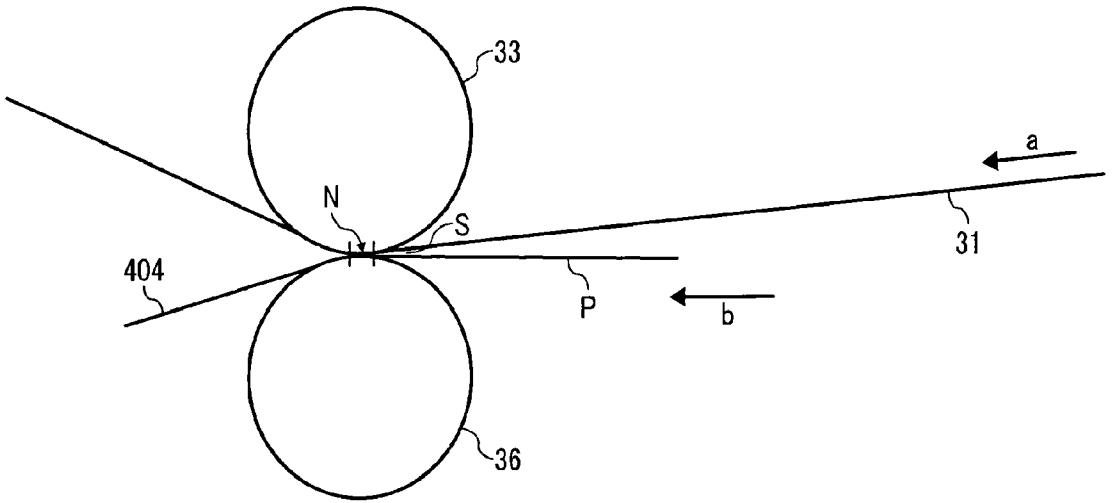
FIGS. 4A and 4B are views of electrical discharge before transfer nip.

While the secondary transfer bias is applied to the secondary-transfer first roller 33, an electrical discharge occurs between the front surface 31*a* of the intermediate transfer belt 31 wound around the secondary-transfer first roller 33 and the recording sheet P entering a secondary transfer nip N where the secondary-transfer first roller 33 contacts the secondary-transfer second roller 36. Such an electrical discharge is referred to as a prenip electrical discharge. As illustrated in FIG. 4A, the secondary-transfer second roller 36 is not offset from a position, at which the secondary-transfer second roller 36 faces the secondary-transfer first roller 33, to the upstream side (i.e., the right side) in a direction b of conveyance of the recording sheet. In this case, toward the right side of the entrance of the secondary transfer nip, a space S is formed between the intermediate transfer belt 31 and the recording sheet P, thereby generating the electrical discharge in the space S.

Figure 4B:
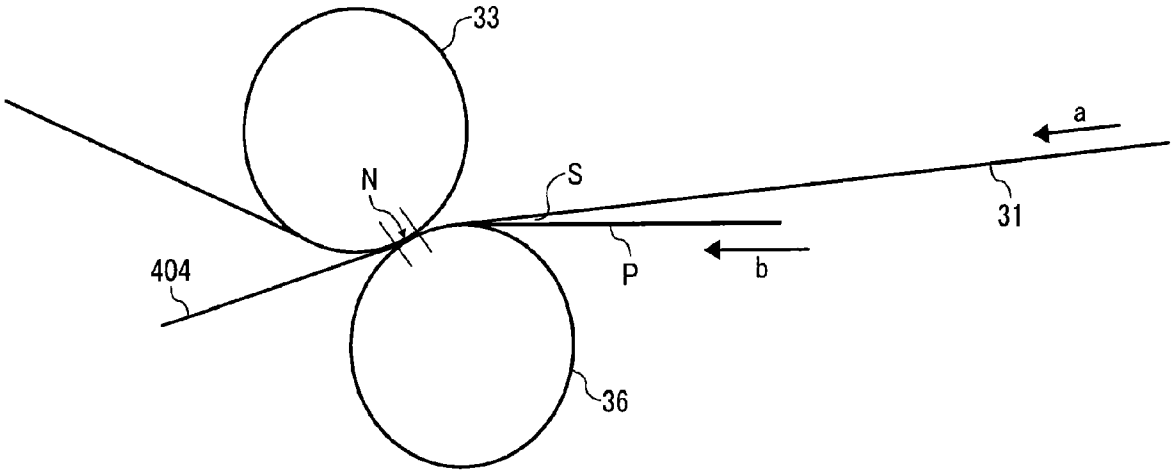

In contrast, referring to FIG. 4B, the secondary-transfer second roller 36 is offset to the upstream side in the direction b of conveyance of the recording sheet. In this case, the recording sheet P comes into contact with the intermediate transfer belt 31 before the recording sheet P enters the secondary transfer nip N where a toner image on the intermediate transfer belt 31 is secondarily transferred onto the secondary transfer belt 404. With this configuration, the space S is small at a portion (the secondary transfer nip N) where the secondary transfer bias is applied to the secondary-transfer first roller 33 to generate a high electric field. Thus, the electrical discharge can be prevented in the space S.

The present inventor's experiment has revealed the following: The likeliness of the occurrence of the prenip electrical discharge varies with the voltage applied to the secondary-transfer first roller 33; the resistances and materials of the intermediate transfer belt 31, the secondary-transfer first roller 33, the secondary-transfer second roller 36, and the secondary transfer belt 404; the type of the recording sheet P; and conveyance conditions. Further, the prenip electrical discharge easily occurs on the intermediate transfer belt 31 made of an elastic material. Therefore, increasing the amount of offset of the secondary-transfer second roller 36 toward the upstream side in the direction b of conveyance of the recording sheet prevents the electrical discharge in the secondary transfer nip N.

Figure 5A:
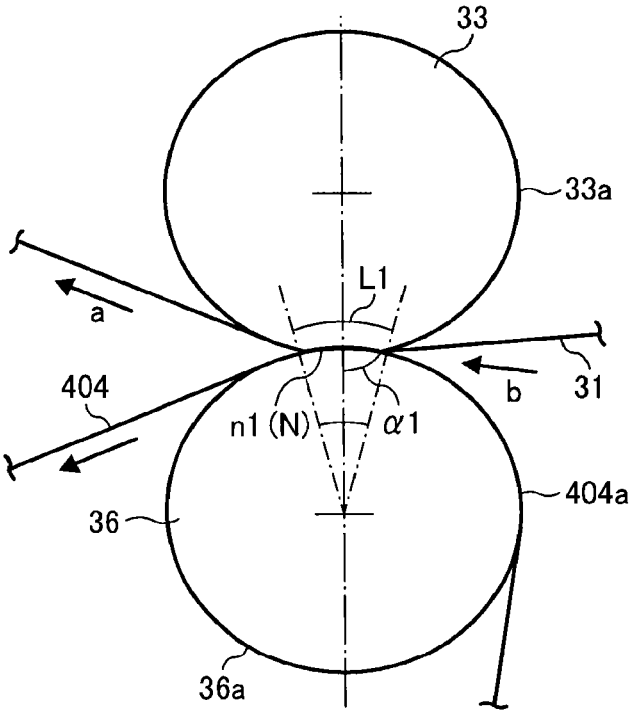
FIG. 5A is a view of a transfer nip.
Figure 5B:
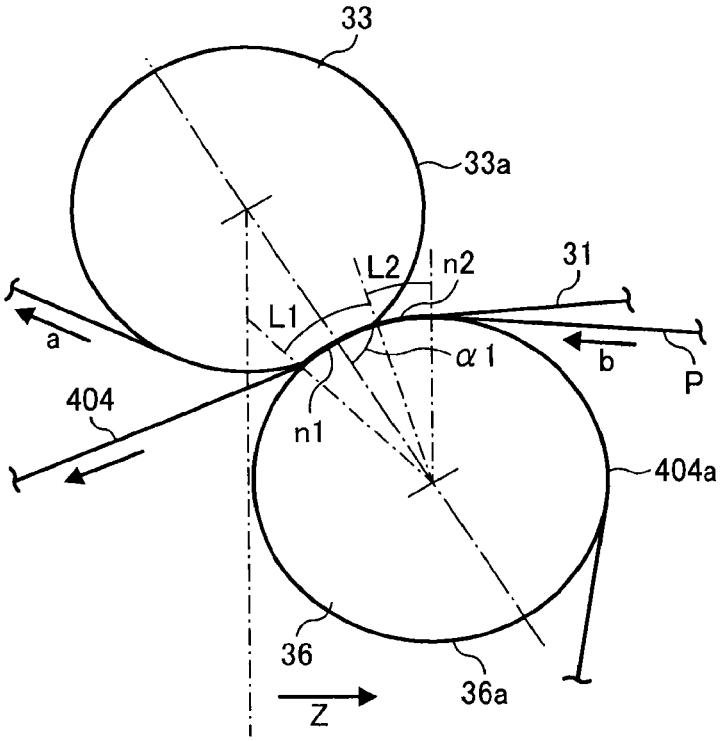
FIG. 5B is a view schematically illustrating a prenip.

Next, referring to FIGS. 5A and 5B, a description is provided of the secondary transfer nip according to the present embodiment.

In FIG. 5A, the intermediate transfer belt 31 and the secondary transfer belt 404 are pressed between the secondary-transfer second roller 36 and the secondary-transfer first roller 33 with a constant pressure. In this case, the secondary-transfer second roller 36 is not offset.

In FIG. 5B, the intermediate transfer belt 31 and the secondary transfer belt 404 are pressed between the secondary-transfer second roller 36 and the secondary-transfer first roller 33 with a constant pressure. In this case, the secondary-transfer second roller 36 is offset toward a direction indicated by arrow Z, that is, the upstream side in the direction of conveyance of the recording sheet.

Assuming that the distance between the center of the secondary-transfer first roller 33 and the center of the secondary-transfer second roller 36, and the manner in which the secondary transfer belt 40 is deformed by the rollers 33 and 36 are the same, the form of a nip is geometrically defined. As illustrated in FIGS. 5A and 5B, the lengths L1 of a nip n1 interposed between the secondary-transfer first roller 33 and the secondary-transfer second roller 36 are the same between FIG. 5A and FIG. 5B. The nip n1 is hereinafter referred to as a main nip n1. In the case of FIG. 5B with the secondary-transfer second roller 36 offset in the direction Z, a prenip n2 indicates a portion of the intermediate transfer belt 31 contacting only the outer circumferential surface 36*a* of the secondary-transfer second roller 36 via the secondary transfer belt 404. The length of the prenip n2 is the length L2.

The presence of the prenip n2 is determined by an angle $\alpha 1$ formed between a straight line connecting the shaft center of the secondary-transfer first roller 33 and the shaft center of the secondary-transfer second roller 36 and the direction of the intermediate transfer belt 31 stretched taut toward the upstream side of the main nip. The straight line is indicated by a broken line in the Figures. As illustrated in FIG. 5A, when the angle $\alpha 1$ is greater than or equal to 90 degrees, the prenip n2 is not formed. In contrast, as illustrated in FIG. 5B, when the angle $\alpha 1$ is less than 90 degree, the prenip n2 is formed.

In the present embodiment, the second transfer belt 404 is employed as a transfer device. In the case of the roller transfer method in which the secondary-transfer second roller 36 is used alone as the transfer device, the length L2 of a portion of the intermediate transfer belt 31, which is directly wound only around the outer circumferential surface 36*a* of the secondary-transfer second roller 36, corresponds to the prenip n2. When the secondary-transfer second roller 36 is not offset as in FIG. 5A, the width L of the secondary transfer nip N refers to the length L1 of the main nip n1. In contrast, when the secondary-transfer second roller 36 is offset as in FIG. 5B, the width L of the secondary transfer nip N refers to the sum of the length L1 of the main nip n1 and the length L2 of the prenip n2.

In the configuration including the prenip n2, when the recording sheet P is in the main nip n1 interposed between the secondary-transfer first roller 33 and the secondary-transfer second roller 36, the back surface of the recording sheet P contacts the outer circumferential surface 36*a* of the secondary-transfer second roller 36 in the prenip n2. The front surface Pa of the recording sheet P contacts the circumferential surface 33*a* of the secondary-transfer first roller 33 via the intermediate transfer belt 31 in the main nip n1. Accordingly, the transfer current of the secondary transfer bias flows spreading in the plane direction of the recording sheet P (interface). In this case, the toner is more likely to be overcharged than the configuration without shifting the offset secondary-transfer second roller 36.

The electrical discharge in the upstream from the secondary transfer nip N in the direction b of conveyance of the recording sheet and the degree of margin in the electrical discharge differ with the type of intermediate transfer belt 31. For example, FIG. 6 indicates test results regarding the presence of the prenip electrical discharge in different type of secondary transfer belts with the amount of offset of the secondary-transfer second roller 36 changed.

It should be noted that the amount of prenip in FIG. 6 refers to the length of the front surface of the intermediate transfer belt 31 contacting only the secondary transfer belt 404 via the recording sheet P. When factors such as the hardness and the track of the intermediate transfer belt 31 to the nip, the diameters of rollers, and so forth other than the position of the secondary-transfer second roller 36 are fixed, the amounts of shift correspond to the amounts of prenip respectively. This is because the prenip is formed by shifting the secondary transfer roller.

Figure 7:
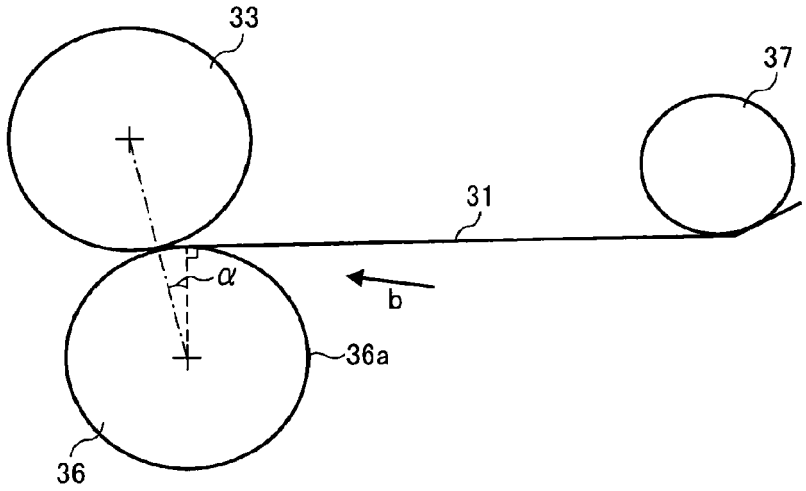
FIG. 7 is a view of an amount of prenip.

Now, there is provided of the amount of prenip in the test of present disclosure referring to FIG. 7.

FIG. 7 is a view of the secondary-transfer first roller 33, the secondary-transfer second roller 36, the intermediate transfer belt 31 made of an elastic material, and the pre-transfer roller 37. The angle $\alpha$ is formed between the broken line connecting the center of the secondary-transfer first roller 33 and the center of the secondary-transfer second roller 36 and the vertical line from the center of the secondary-transfer second roller 36 to the intermediate transfer belt 31. The amount of prenip is defined by $2\pi\times$(the radius of the secondary-transfer second roller 36)$\times\alpha/360$ degree. The term "prenip" refers to a portion, which is wound around the outer circumferential surface 36*a* of the secondary-transfer second roller 36, of the secondary transfer belt 31. Accordingly, the amount of prenip varies with the diameter of the secondary-transfer second roller 36 and the trajectory of the intermediate transfer belt 31. With the variable factors fixed, the amount of prenip is determined by the amount of offset of the secondary-transfer second roller 36. In FIG. 6 indicating the relations between the amount of prenip and the electrical discharge, the amount of prenip varies with the changes in the amount of offset.

In FIG. 6, the degree of margin in the electrical discharge is determined by various factors: belt type, the amount of prenip, paper types, and the amount of the secondary transfer current. The belt has two types such as an elastic belt and a polyimide (PI) belt. The amount of prenip is changed by shifting the secondary-transfer second roller 36 toward the upstream side in the direction of conveyance. Ordinary paper and thin paper are used. The amount of the secondary transfer current is changed as the secondary transfer bias. In FIG. 6, the term "GOOD" indicates that no image failure due to the electrical discharge was found. The term "FAIR" indicates that the electrical discharge slightly occurred. The term "POOR" indicates that image failure was easily found.

According to FIG. 6, higher the secondary transfer current, higher the secondary transfer voltage. That is, as the secondary transfer current is high, the electrical discharge easily occurs. If no electrical discharge occurs in a wider range of current, that is, even when high secondary transfer current is applied, the degree of margin in the electrical discharge is high. In the present embodiment, to provide favorable transferability, the target current A1 is set−120 μA, at which it is necessary to generate no electrical discharge. In view of the transferability, it is necessary that the amount of prenip in the elastic belt is greater than or equal to 4 mm, and greater than or equal to 2 mm in the PI belt.

It should be noted that the test results (numerical values) indicated in FIG. 6 vary with the factors such as the film thickness, hardness, and process linear velocity of belt, and the diameter of the secondary transfer roller. That is, a necessary amount of prenip varies with an image forming apparatus. When compared in the same configuration, the degree of margin in electrical discharge is higher than the PI belt does. The amount of the main nip n1, which is illustrated in FIGS. 5A and 5B, is typically set from 2 mm to 5 mm.

Next, a more detailed description is provided of the present embodiment.

In the configuration of FIG. 7, the secondary-transfer first roller 33 and the secondary-transfer second roller 36 have the same diameters. The secondary-transfer second roller 36 has a hardness of 70 HS in accordance with Japanese Industrial Standards (JIS-A), and the secondary-transfer first roller 33 has 50° on Asker C hardness scale. When the secondary-transfer second roller 36 is harder, the intermediate transfer belt 31 favorably exhibits the property of rubber. However, the combination of hardness of and the magnitude relation between the secondary-transfer first roller 33 and the secondary-transfer second roller 36 are not limited to those described above, and various numerical values and relations are available.

Further, irrespective of the relation between the diameter of the secondary-transfer first roller 33 and that of the secondary-transfer second roller 36 and the magnitude relation of the rollers 33 and 36, the image forming apparatus according to the present embodiment exhibits advantageous effects.

In the present embodiment, as illustrated in FIG. 7, the secondary-transfer second roller 36 is offset toward the upstream side in the direction b of conveyance of the recording sheet, causing the recording sheet P, which is advancing forward, to contact the intermediate transfer belt 31 at the upstream from the secondary transfer nip N. Accordingly, no space S as illustrated in FIG. 4B is formed between the intermediate transfer belt 31 and the recording sheet P before the secondary transfer nip N, thereby preventing the electrical discharge. Now, there is provided of the advantageous effects of the present embodiment from the viewpoint of the electric field. In the distribution of the transfer electric field, the strongest electric field is generated in the secondary transfer nip N, becoming weaker toward the upstream side in the direction of conveyance. When the recording sheet P comes to contact with the intermediate transfer belt 31 at the strong electric field, with a space S between the recording sheet P and the intermediate transfer belt 31 at the upstream of the strong electric field, the electrical discharge occurs in the space S. Therefore, contacting the recording sheet P with the intermediate transfer belt 31 at the upstream side of the weak electric field (the nip N) prevents the electrical discharge.

In the present embodiment, the secondary transfer bias is output from the power source 39 under constant current control to provide a constant transfer voltage (transfer electric field) irrespective of the resistances of the intermediate transfer belt 31 and the recording sheet P.

Next, a description is provided of different methods for measuring the amount of prenip with reference to FIGS. 8A through 8D and 9.

Figure 8A:
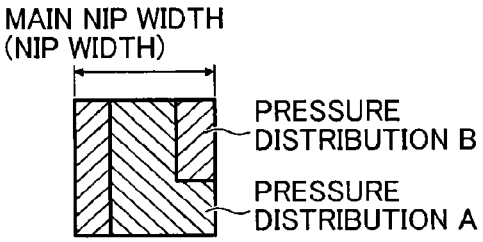
FIGS. 8A through 8D illustrate a process for measuring an amount of prenip.

In a method 1 for measuring the amount of prenip as illustrated in FIGS. 8A through 8D, the width of a main nip is first measured as illustrated in FIG. 8A. To measure the width of the main nip, a surface pressure sensor (i.e., I-SCAN (registered trademark), manufactured by Nitta Corporation) is used to specify a portion under pressure. More specifically, a pressure distribution A and a pressure distribution B indicated by differently hatched patterns are obtained, and the width of a portion under a pressure greater than a threshold is defined as the width of the main nip.

Figure 8B:
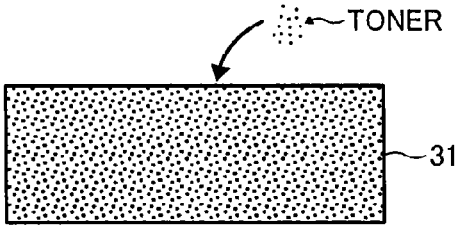
Figure 8C:
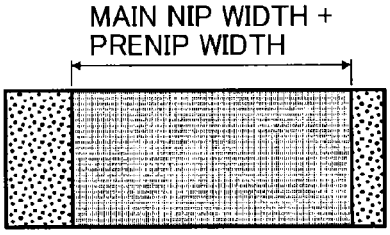

Next, the width of the main nip and a prenip is measure as illustrated in FIG. 8B. In this measurement, toner is caused to be adhered onto the intermediate transfer belt 31 in a certain degree of width, e.g., approximately 10 mm which is sufficiently wider than the width of the secondary transfer nip N.

Subsequently, a secondary transfer device is repeatedly moved to contact and separate from the intermediate transfer belt 31 with toner adhered onto. In the present embodiment, the secondary transfer unit 41 is moved to contact and separate from the secondary-transfer first roller 33. During such an operation, the secondary transfer unit 41 is drawn out to be cleaned as needed. After cleaned, the secondary transfer unit 41 is repeatedly moved again. When the secondary-transfer second roller 36 is used an the transfer device instead of the secondary transfer belt 404, the secondary-transfer second roller 36 is moved to contact and separate from the secondary-transfer first roller 33. Through such an operation of contact and separation, a portion of toner adhered onto the intermediate transfer belt 31 is repeatedly pressed by the secondary transfer device, so that the thickness of the portion becomes thin. This thin portion corresponds to a contact portion (the main nip and the prenip) where the secondary transfer device contacts the secondary transfer belt 31.

Figure 8D:
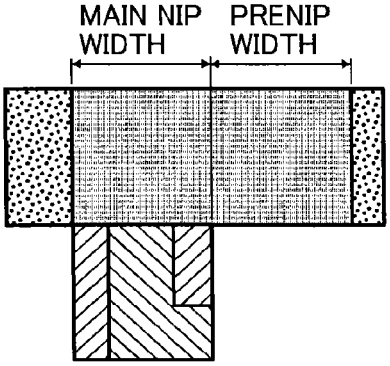

Referring to FIG. 8D, the width of the contact portion (the main nip and the prenip) is measured. Then, the width of the main nip is subtracted from this measured width to obtain the width of the prenip, which is the amount of the prenip.

Figure 9A:
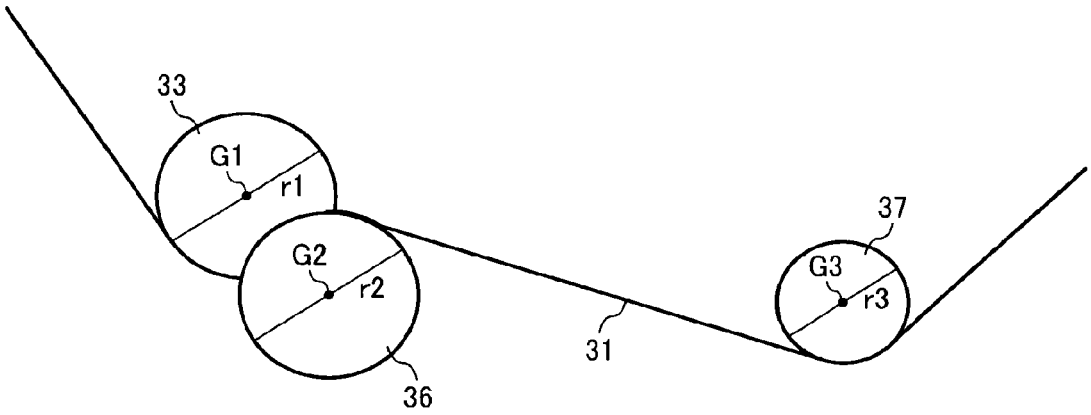
FIGS. 9A and 9B illustrate another process for measuring an amount of prenip.
Figure 9B:
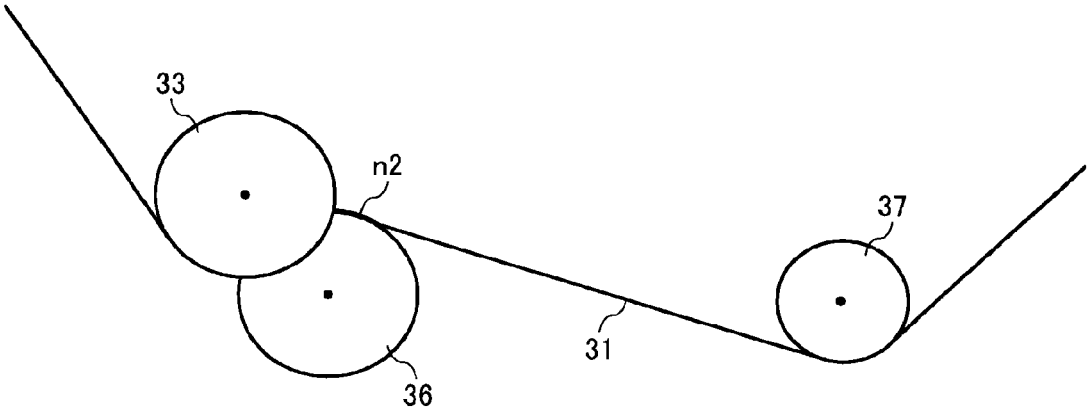

In a method 2 of FIGS. 9A and 9B, the coordinates of the shaft centers G1, G2, and G3 are first specified as illustrated in FIG. 9A. G1, G2, and G3 are the shaft centers of the secondary-transfer second roller 36, the secondary-transfer first roller 33, and the pre-transfer roller 37, respectively. Then, the outer diameters r1 and r2 and hardnesses of the secondary-transfer second roller 36 and the secondary-transfer first roller 33, and the outer diameter r3 of the pre-transfer roller 37 are measured.

Subsequently, the three rollers 33, 36, and 37 are outlined as illustrated in FIG. 9B. In this case, based on the measured hardnesses of the rollers 33 and 36, it is assumed that only either one having a lower hardness is deformed. Referring to the outline, a portion of the intermediate transfer belt 31 is wound around only the secondary-transfer second roller 36. This portion is defined as a prenip n2. Using the two methods as described above can specify the prenip n2.

It should be noted that the prenip refers to a portion in which the secondary-transfer first roller 33 and the secondary-transfer second roller 36 do not contact with each other, and an image bearer formed into a belt (the intermediate transfer belt 31) is wound around only the outer circumferential surface 36*a* of the secondary-transfer second roller 36 via the secondary transfer belt 404. The length of this portion is approximately 2 to 5 mm. This length of the portion is referred to as the amount of the prenip. The secondary-transfer first roller 33 and the secondary-transfer second roller 36 contact with each other to form a nip (which is referred to as a main nip). The length (amount) of the nip is approximately 2 to 5 mm.

Figure 10:
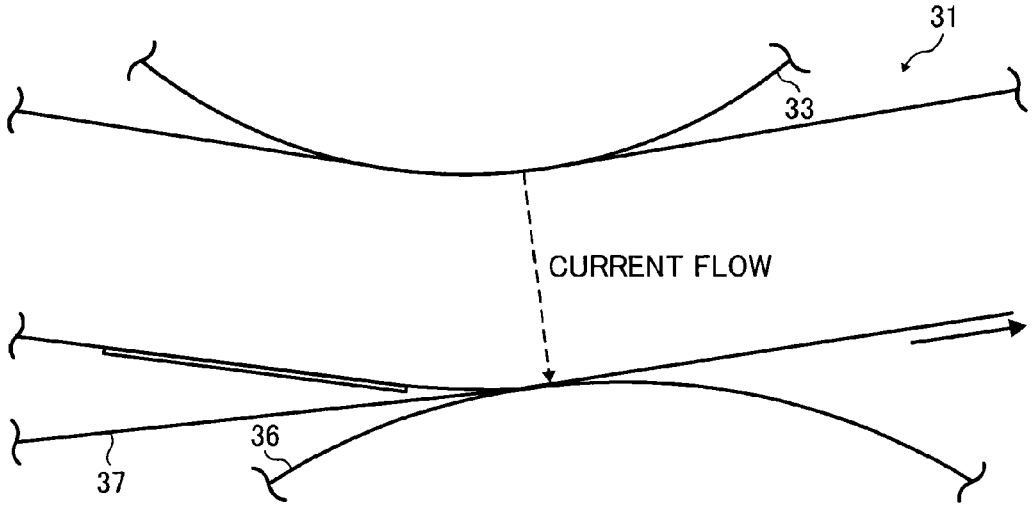
FIG. 10 is an enlarged view of a secondary transfer nip and a surrounding around a secondary transfer nip using a single-layer intermediate transfer belt which is different from the image forming apparatus of the present disclosure.

FIG. 10 is an enlarged diagram schematically illustrating a structure around the secondary transfer nip using a single-layer intermediate transfer belt as the intermediate transfer belt 31. In a case in which the single-layer intermediate transfer belt is used as the intermediate transfer belt 31, a secondary transfer current flows between the secondary-transfer first roller 33 and the secondary-transfer second roller 36 in a manner described below. That is, the secondary transfer current is concentrated at the nip center (the center in the traveling direction of the belt) and flows linearly as indicated by arrow in FIG. 24. In other words, the secondary transfer current does not flow much near the nip start portion of the secondary transfer nip and near the nip end portion of the secondary transfer nip. When the secondary transfer current flows in such a manner described above, the time period during which the secondary transfer current acts on the toner is relatively short at the secondary transfer nip. Accordingly, excessive injection of electrical charges having a polarity opposite that of the normal polarity due to the secondary transfer current is suppressed, if not prevented entirely.

Figure 11:
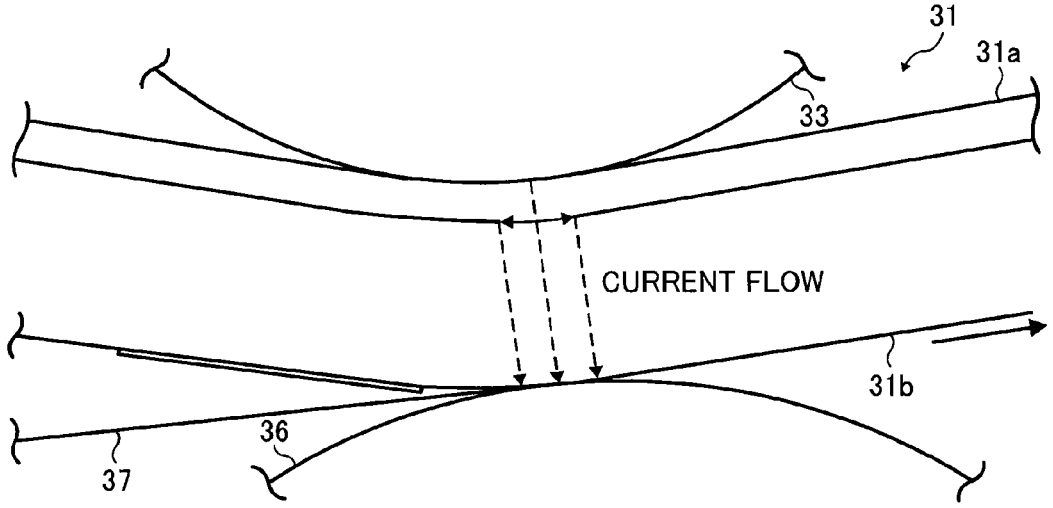
FIG. 11 is a partially enlarged cross-sectional view of a secondary transfer nip and a surrounding structure in the image forming apparatus according to an embodiment.

FIG. 11 is a partially enlarged cross-sectional view schematically illustrating the secondary transfer nip and a surrounding structure according to an embodiment of the present disclosure. According to the present embodiment, as described above, a multi-layer intermediate transfer belt is used as the intermediate transfer belt 31. In a case in which the multi-layer intermediate transfer belt is used as the intermediate transfer belt 31, a secondary transfer current flows between the secondary-transfer first roller 33 and the secondary-transfer second roller 36 in a manner described below. When using the multilayer intermediate transfer belt as the intermediate transfer belt 31, the secondary transfer current flows through an interface between the base layer 310 and the elastic layer 311 in the belt thickness direction while the secondary transfer current spreads in the circumferential direction of the intermediate transfer belt 31. As a result, the secondary transfer current flows not only in the center of the secondary transfer nip, but also at the nip start portion and at the nip end portion. This means that the secondary transfer current acts on the toner in the secondary transfer nip for an extended period of time. Thus, electrical charges having a polarity opposite to the normal polarity are easily and excessively injected to the toner due to the secondary transfer current, which results in a significant decrease in the amount of charge of the toner having the normal polarity and also results in an opposite charging of the toner. In both cases, the secondary transfer ability is impaired. As a result, the image density easily becomes insufficient. Not only the belt of a two-layer structure such as in the present embodiment, but also the belt having multiple layers including three more layers causes the similar spread of the secondary transfer current, which also impairs the secondary transfer ability.

Embodiment 1

As described above, forming a prenip n2 prevents an electrical discharge. However, forming the prenip n2 leads to an increase in the total amount of a secondary transfer nip N as illustrated in FIG. 5B, which causes a transfer current to laterally flow along the surface of the recording sheet P toward the secondary-transfer second roller 36 that is grounded. This may overcharge toner, resulting in a degradation of transferability (a transfer failure) during the secondary transfer.

The intermediate transfer belt 31 as an belt-shaped image bearer having multiple layers causes the similar spread of the secondary transfer current, thereby hampering the secondary transferability.

Therefore, in the present embodiment, a power source 39 applies a superimposed bias, in which an alternating current (AC) voltage, that is, an alternating current (AC) component is superimposed on a direct current (DC) voltage, that is, a direct current (DC) component, to a secondary-transfer first roller 33, as a secondary transfer bias. The power source 39 further applies the secondary transfer bias having a waveform with a high duty. In the present embodiment, a high-duty bias refers to a bias with a duty of 50% or greater.

Figure 12A:
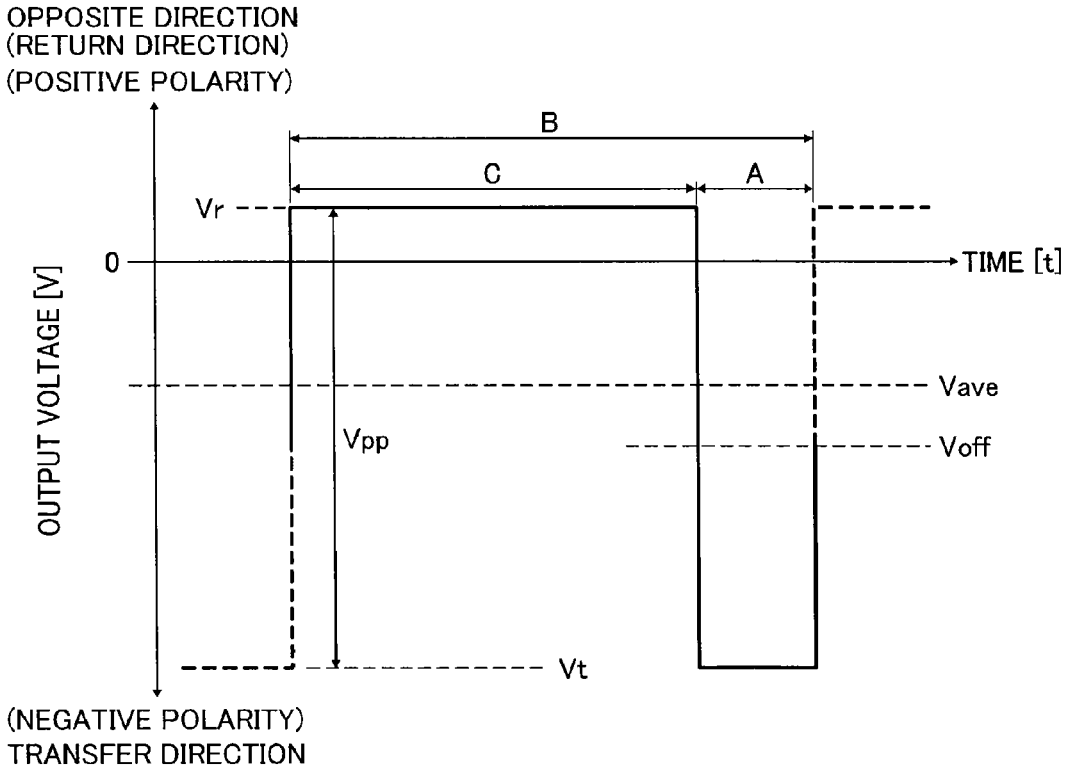
FIG. 12A is a graph of an example of an ideal waveform of a bias with a high duty output from a transfer bias power source according to an embodiment of the present disclosure.

Referring to FIG. 12A, in a waveform with a high duty, a duration A of a peak voltage Vt (a transfer direction) that transfers a toner image from an intermediate transfer belt 31 (an image bearer) side to a recording sheet P side is less than 50% in one cycle of the alternating voltage applied. Further, a duration C of a voltage smaller than the peak voltage Vt or of a peak voltage Vr (the direction opposite to the transfer direction), whose polarity is opposite to that of the peak voltage Vt is greater than 50% in one cycle of the alternating voltage applied. Thus, while applying the peak voltage Vt to transfer toner onto the recording sheet P, the power source 39 applies the voltage smaller than the peak voltage Vt or the peak voltage Vr having a opposite polarity from that of the peak voltage Vt for a longer period of time than the peak voltage Vt does. This configuration prevents the toner from being overcharged while the toner image passes through the secondary transfer nip N.

In the present embodiment, when the linear velocities E1 and E2 of each photoconductor and the intermediate transfer belt 31 respectively are changed, the value of only the DC voltage in the secondary transfer bias (the superimposed bias) is changed. More specifically, when the linear velocities E1 and E2 are −E1 and −E2 respectively, which are lower than a reference speed Ea, the value of the DC voltage, instead of the AC voltage, is decreased compared to at the reference speed Ea. That is, the value of the DC voltage in the secondary transfer bias (the superimposed bias) is changed according to the linear velocities E1 and E2 of each photoconductor and the intermediate transfer belt 31 respectively. More specifically, the power source 39 as the transfer bias power source is under control such that the absolute value of the DC voltage decreases as the linear velocities E1 and E2 of each photoconductor and the intermediate transfer belt 31 respectively reduce.

For example, decreasing only the value of the AC component relatively reduces the amount of electric charges having the same polarity as the polarity of toner, which leads to the excessive transfer, thus deteriorating the transferability of the secondary transfer. As a result, transfer failure occurs.

However, in the present embodiment, at the linear velocities −E1 and −E2 lower than the linear velocities E1 and E2 respectively, decreasing the value of only the DC voltage (the DC component), without changing the value of the AC voltage (the AC component), prevents supplying electric charges having a polarity opposite to the polarity of charging toner to the toner. That is, supplying the electric charges having the same polarity as the polarity of toner prevents a reduction in the toner charged with an opposite polarity to the polarity of toner, thereby preventing the overcharge of toner. This further prevents the overcharge of toner in the secondary transfer nip N even with the transfer bias of a high duty applied, thus improving the transferability.

Figure 13:
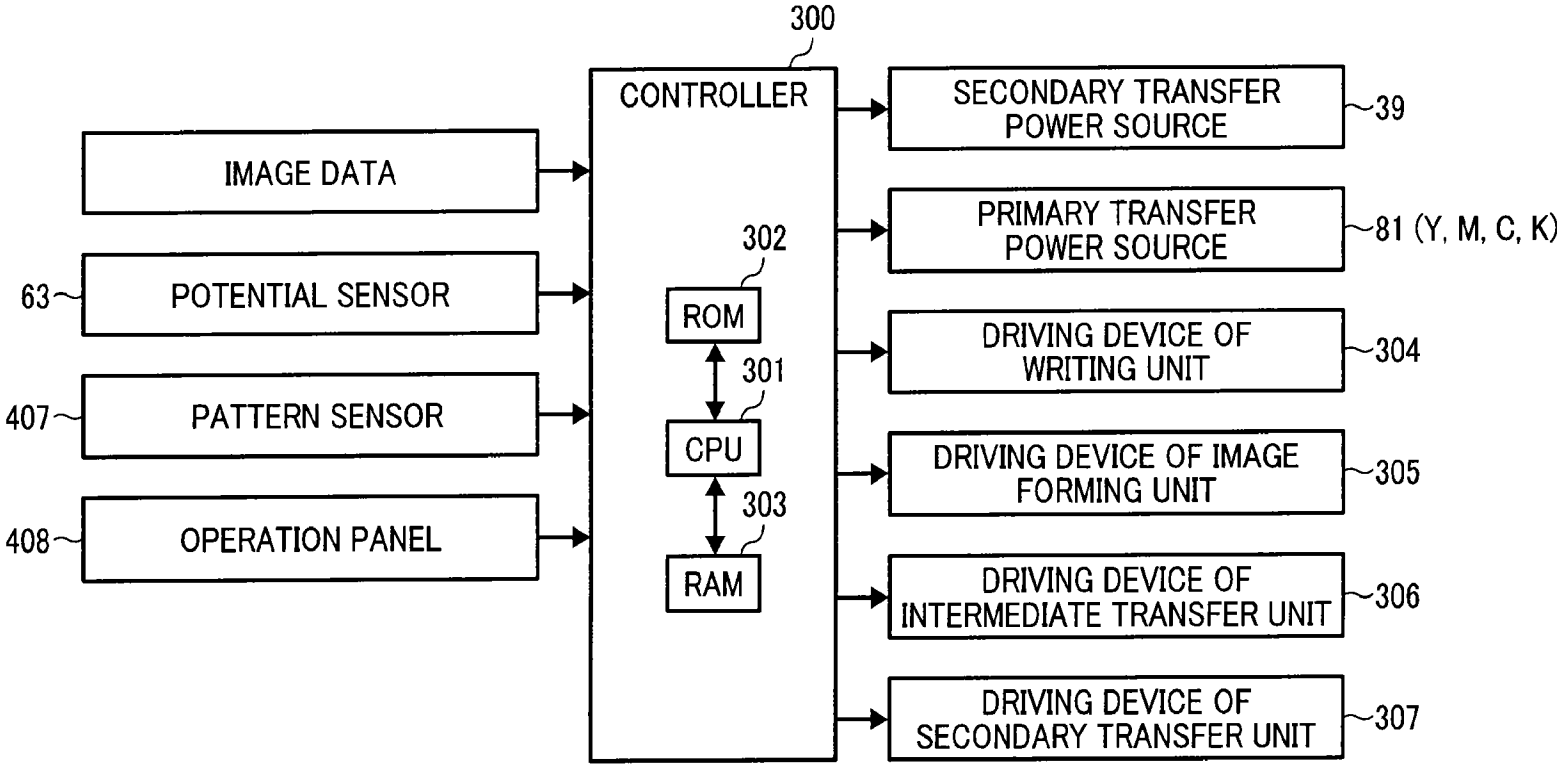
FIG. 13 is a block diagram of a control system according to one embodiment.
Figure 14:
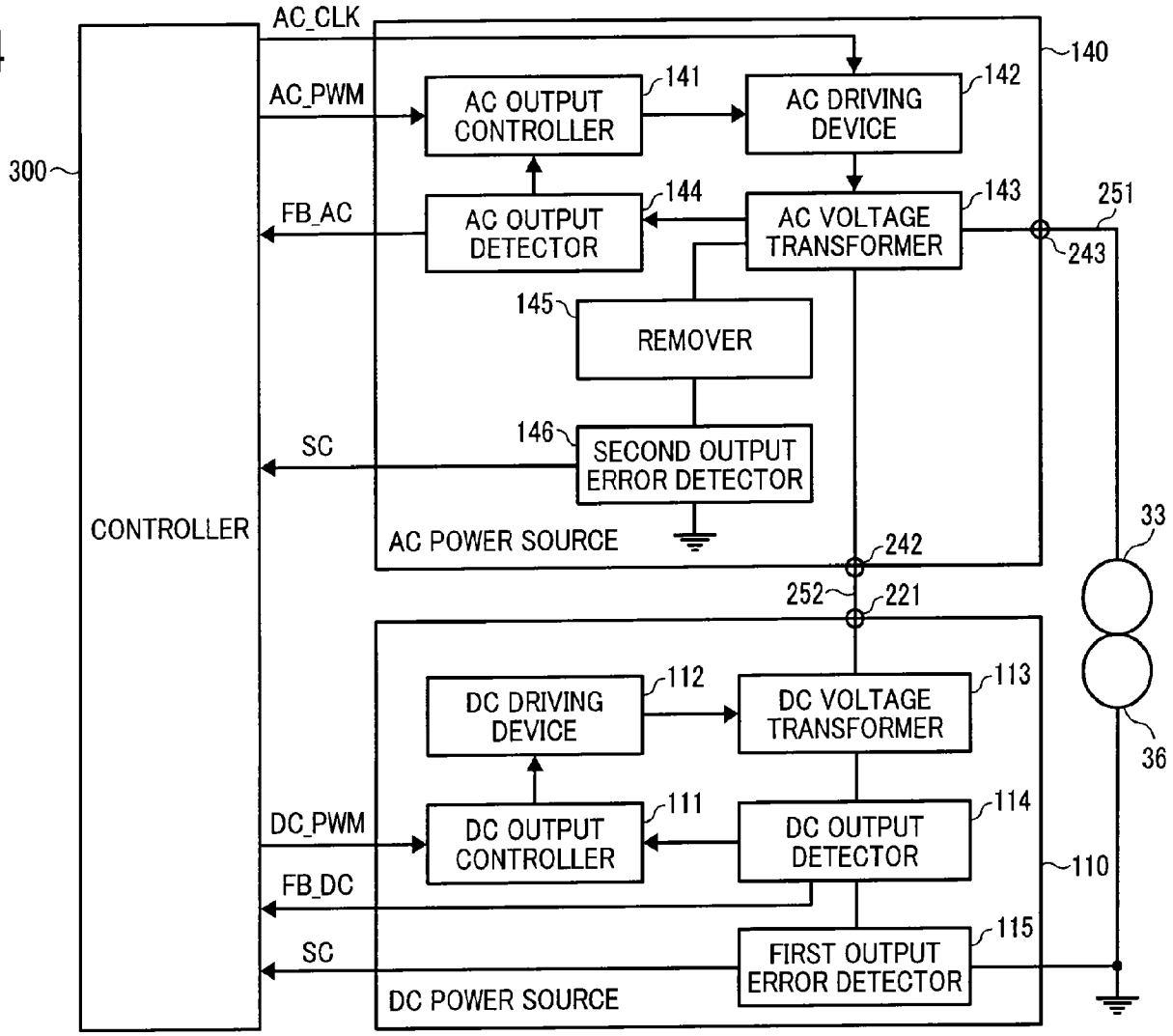
FIG. 14 is a block diagram of a part of an electric circuit of a transfer bias power source and one embodiment of constitutional elements as an example of the present disclosure.

Next, a description is provided of the image forming apparatus 100, referring to FIGS. 13 and 14.

As illustrated in FIG. 13, a controller 300 includes a central processing unit (CPU) 301 as a computing device, a read only memory (ROM) 302 as a nonvolatile memory, and a random access memory (RAM) 303 as a temporary storage device. The controller 300 typically includes various constitutional components and sensors communicably connected thereto via signal lines to control the entirety of the image forming apparatus. FIG. 13 illustrates representative components and sensors of the image forming apparatus 100. It should be noted that FIG. 13 illustrates the components and sensors employed in the present embodiments, and a description is provided of the components and sensors as devices that serve as the controller 300.

The controller 300 includes a potential sensor 63, a pattern sensor 407, and an operation panel 408 as a setting device, which are connected to each other via signal lines, on an input side. The controller further includes a power source 39 for secondary transfer, power sources for primary transfer 81Y, 81M, 81C, and 81K for the colors yellow, magenta, cyan, and black, a driving device 304 of a writing unit, a driving device 305 of an image forming unit, a driving device 306 of an intermediate transfer unit, and a driving device 307 of a secondary transfer unit, which are connected to each other via signal lines, on an output side.

The operation panel 408 includes a display unit and a operation unit, to allow an operator, such as a user or a serving staff, to input and set various information. The controller 300 then receives the various information input or set by the operator. The controller 300 sends the received various information to be displayed on the operation panel 408.

The power sources for primary transfer 81Y, 81M, 81C, and 81K apply a primary transfer bias to primary transfer rollers 35Y, 35M, 35C, and 35K.

The power source 39 applies a secondary transfer bias to a secondary-transfer first roller 33. The controller 300 controls the output from the power source 39. Alternatively, in some embodiments, another controller 300 controls the output of the power source 39, independently of the controller that controls the entirety of the image forming apparatus.

The controller 300 of the image forming apparatus 100 includes an image adjustment mode to adjust the density of an image density. The controller 300 compares the value detected by the potential sensor 63 with a predetermined value to determine whether it is an image adjustment timing. When the detection value is less than the predetermined value, an affirmative determination is made to initiate the image adjustment mode.

In the present embodiment, the image forming apparatus 100 includes an image adjustment mode to adjust image formation conditions. In the image forming apparatus 100, to adjust the image formation conditions with the image adjustment mode, a developing bias and a charging bias are changed to form a test pattern with toner, known as a density adjustment pattern. Then, the formed test pattern is transferred onto the secondary transfer belt 404, and the density of the test pattern is detected by the pattern sensor 407. The detected result (value) is used to adjust the image formation conditions. These operations are performed by the controller 300. According to the present embodiment, the density of the test pattern is detected on the secondary transfer belt 404. Alternatively, in some embodiment, the density is detected on the intermediate transfer belt 31.

In response to the initiation of the image adjustment mode, the controller 300 drives the driving device 304 of the writing unit and the driving device 305 of the image forming unit so as to form test patterns on the respective photoconductors. Subsequently, the controller 300 drives the power sources 81Y, 81M, 81C, and 81K for primary transfer and the driving device 306 of the intermediate transfer unit to transfer the test patterns (toner images) onto the intermediate transfer belt 31. The controller 300 also drives the power source 39 for secondary transfer and the driving device 307 of the secondary transfer unit to transfer the test patterns from intermediate transfer belt 31 onto the secondary transfer belt 404.

FIG. 14 is a block diagram illustrating a main portion of an electrical circuit of a secondary transfer power source together with a secondary-transfer first roller 33 and a secondary-transfer second roller 36. The power source 39 includes a direct current power source (hereinafter, referred to as a DC power source) 110 and an alternating current power source (hereinafter, referred to as an AC power source) 140. The power source 39 is connected with a controller 300 to control the output from the power source 39. In some embodiments, the power source 39 includes another controller.

The DC power source 110 outputs a DC voltage to apply an electrostatic force to toner on the front surface 31*a* of the intermediate transfer belt 31 so that the toner moves from the belt side to the recording sheet P side in the secondary transfer nip N. The DC power source 110 includes a DC output controller 111, a DC driving device 112, a DC voltage transformer 113, a DC output detector 114, a first output error detector 115, an electrical connector 221, and so forth.

The AC power source 140 outputs an AC voltage to form an alternating electric field in the secondary transfer nip N. The AC power source 140 includes an AC output controller 141, an AC driving device 142, an AC voltage transformer 143, an AC output detector 144, a remover 145, a second output error detector 146, electrical connectors 242 and 243, and so forth.

The controller 300 inputs a DC_PWM signal and an output value of the DC voltage transformer 113 detected by the DC output detector 114 to the DC output controller 111. The DC_PWM signal controls an output level of the DC voltage. Based on the duty ratio of the input DC_PWM signal and the output value of the DC voltage transformer 113, the DC output controller 111 controls the DC voltage transformer 113 via the DC driving device 112 to adjust the output value of the DC voltage transformer 113 to an output value instructed by the DC_PWM signal. The DC_PWM signal controls an output level of the DC voltage. Based on the duty ratio of the input DC_PWM signal and the output value of the DC voltage transformer 113, the DC output controller 111 controls the DC voltage transformer 113 via the DC driving device 112 to adjust the output value of the DC voltage transformer 113 to an output value instructed by the DC_PWM signal.

The DC driving device 112 drives the DC voltage transformer 113 in accordance with the instruction from the DC output controller 111. The DC driving device 112 drives the DC voltage transformer 113 to output a DC high voltage having a negative polarity. In a case in which the AC power source 140 is not connected, the electrical connector 221 and the secondary-transfer first roller 33 are electrically connected by a harness 251 so that the DC voltage transformer 113 outputs (applies) a DC voltage to the secondary-transfer first roller 33 via the harness 251. In a case in which the AC power source 140 is connected, the electrical connector 221 and the electrical connector 242 are electrically connected by a harness 252 so that the DC voltage transformer 113 outputs a DC voltage to the AC power source 140 via the harness 252.

The DC output detector 114 detects and outputs an output value of the DC high voltage from the DC voltage transformer 113 to the DC output controller 111. The DC output detector 114 outputs the detected output value as a FB_DC signal (feedback signal) to the controller 300 to control the duty of the DC_PWM signal in the controller 300 so as not to impair transferability due to environment and load. According to the present embodiment, the AC power source 140 is detachably mountable relative to the body of the power source 39. Thus, an impedance in the output path of the high voltage output is different between when the AC power source 140 is connected and when the AC power source 140 is not connected. Consequently, when the DC power source 110 outputs the DC voltage under constant voltage control, the impedance in the output path changes depending on the presence of the AC power source 140, thereby changing a division ratio. Furthermore, the high voltage to be applied to the secondary-transfer first roller 33 varies, causing the transferability to vary depending on the presence of the AC power source 140.

In view of the above, according to the present embodiment, the DC power source 110 outputs the DC voltage under constant current control, and the output voltage is changed depending on the presence of the AC power source 140. With this configuration, even when the impedance in the output path changes, the high voltage to be applied to the secondary-transfer first roller 33 is kept constant, thereby maintaining reliably the transferability irrespective of the presence of the AC power source 140. Furthermore, the AC power source 140 can be detached and attached without changing the DC_PWM signal value. According to the present embodiment, the DC power source 110 is under constant-current control. Alternatively, in some embodiments, the DC power source 110 can be under constant voltage control as long as the high voltage to be applied to the secondary-transfer first roller 33 is kept constant by changing the DC_PWM signal value upon detachment and attachment of the AC power source 140 or the like.

The first output error detector 115 is disposed on an output line of the DC power source 110. When an output error occurs due to a ground fault or other problems in an electrical system, the first output error detector 115 outputs an SC signal indicating the output error such as leakage. With this configuration, the power source controller 300 stops the DC power source 110 to output the high voltage.

The power source controller 300 inputs an AC_PWM signal and an output value of the AC voltage transformer 143 detected by the AC output detector 144 to the AC output controller 141. The AC_PWM signal controls an output level of the AC voltage. Based on the duty ratio of the input AC_PWM signal and the output value of the AC voltage transformer 143, the AC output controller 141 controls the AC voltage transformer 143 via the AC driving device 142 to adjust the output value of the AC voltage transformer 143 to an output value instructed by the AC_PWM signal. The AC_PWM signal controls an output level of the AC voltage. Based on the duty ratio of the input AC_PWM signal and the output value of the AC voltage transformer 143, the AC output controller 141 controls the AC voltage transformer 143 via the AC driving device 142 to adjust the output value of the AC voltage transformer 143 to an output value instructed by the AC_PWM signal.

An AC_CLK signal to control the output frequency of the AC voltage is input to the AC driving device 142. The AC driving device 142 drives the AC voltage transformer 143 in accordance with the instruction from the AC output controller 141 and the AC_CLK signal. As the AC driving device 142 drives the AC voltage transformer 143 in accordance with the AC_CLK signal, the output waveform generated by the AC voltage transformer 143 is adjusted to a desired frequency instructed by the AC_CLK signal.

The AC driving device 142 drives the AC voltage transformer 143 to generate an AC voltage, and the AC voltage transformer 143 then generates a superimposed voltage in which the generated AC voltage and the DC high voltage output from the DC voltage transformer 113 are superimposed. In a case in which the AC power source 140 is connected, that is, the electrical connector 243 and the secondary-transfer first roller 33 are electrically connected by the harness 251, the AC voltage transformer 143 outputs (applies) the thus-obtained superimposed voltage to the secondary-transfer first roller 33 via the harness 251. In a case in which the AC voltage transformer 143 does not generate the AC voltage, the AC voltage transformer 143 outputs (applies) the DC high voltage output from the DC voltage transformer 113 to the secondary-transfer first roller 33 via the harness 251. Subsequently, the voltage (the superimposed voltage or the DC voltage) provided to the secondary-transfer first roller 33 returns to the DC power source 110 via the secondary-transfer second roller 36.

The AC output detector 144 detects and outputs an output value of the AC voltage from the AC voltage transformer 143 to the AC output controller 141. The AC output detector 144 outputs the detected output value as a FB_AC signal (feedback signal) to the power source controller 300 to control the duty of the AC_PWM signal in the power source controller 300 to prevent the transferability from dropping due to environment and load. The AC power source 140 carries out constant voltage control. Alternatively, in some embodiments, the AC power source 140 may carry out constant current control. The waveform of the AC voltage generated by the AC voltage transformer 143 (the AC power source 140) is either a sine wave or a square wave. According to the present embodiment, the waveform of the AC voltage is a short-pulse square wave. The AC voltage having a short-pulse square wave enhances image quality.

A description is provided later of the secondary transfer bias according to the present embodiment.

Figure 12B:
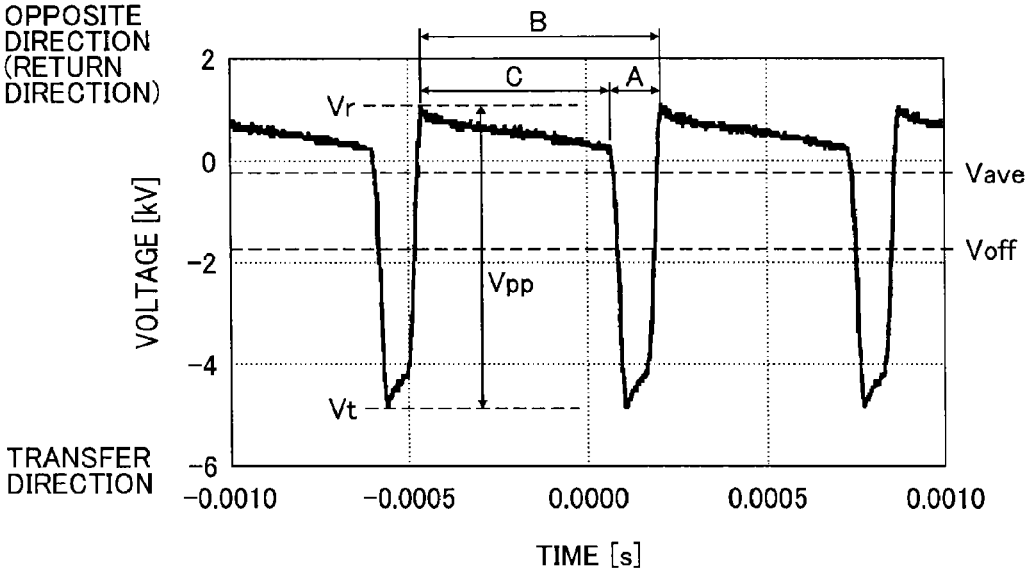
FIG. 12B is a graph of an example of an actual waveform of the bias with a high duty of FIG. 12A.

FIGS. 12A and 12B are waveform charts showing a waveform of a secondary transfer bias output from the power source 39 according to an embodiment of the present disclosure. To transfer a toner image onto the recording sheet P, a constant amount of voltage is applied to the secondary transfer nip N. However, continuing to apply the voltage leads to overcharging of toner, which generates transfer failure.

FIG. 12A illustrates an ideal waveform for transferring a halftone image output. In the waveform of FIG. 12A, a requisite amount of voltage with a high duty greater than 50% is applied as the secondary transfer bias, so that a duration of the applied voltage is short and the overcharge of toner is prevented. The symbols in FIG. 12A are as follows: Vr is a peak value of a positive voltage (a peak value of a voltage having an opposite polarity/a peak value of a voltage in an opposite direction (an opposite-directional voltage)); Vt is a peak value of a negative voltage (a peak value of a voltage in a transfer direction (a transfer-directional voltage)); Voff (a peak-to-peak value) is (Vr+Vt)/2; Vpp is Vr−Vt; Vave is Vr×Duty/100+Vt×(1−Duty)/100; A is a duration of Vt; B is a total time period of one cycle of voltage waveform; Duty is (B−A)/B×100%; and C is a duration of Vr. The term "duty" refers to a ratio of a duration of Vt (a time period of application of the transfer-directional voltage) to a duration of Vr (a time period of application of the return-directional voltage) in one cycle of an alternating voltage waveform. When a ratio of a value obtained by subtracting A from B with respect to B is greater (higher) than 50%, or C is greater than A by 50%, it is called a high duty.

Voff of FIGS. 12A and 12B refers to the value of the DC voltage (the DC component), which is a value at center between the peak value Vt of the transfer-directional voltage of the secondary transfer bias and the peak value Vr of the return-directional voltage of the secondary transfer bias.

FIG. 12B illustrates a waveform of a voltage actually applied to obtain the ideal waveform of FIG. 12A. The conditions for the alternating voltage applied are as follows: Vt is −4.8 kV; Vr is 1.2 kV; Voff is −1.8 kV; Vave is 0.08 kV; Vpp is 6.0 kV; a duration A of Vt peak is 0.10 ms; a cycle B of a waveform is 0.66 ms; and Duty is 85%.

That is, when the secondary transfer bias has the positive-polarity peak value Vt, electrostatic migration of the toner from the inter mediate transfer belt 31 side to the recording sheet P side is inhibited. When the secondary transfer bias has the negative-polarity peak value Vt, electrostatic migration of the toner from the intermediate transfer belt 31 side to the recording sheet P side is accelerated.

Adopting such secondary transfer bias shortens a time period, during which electric charges having an opposite polarity (a positive polarity) to the charge polarity of toner is injected to toner. This prevents a reduction in the amount of charge of toner within the secondary transfer nip N due to the injection of the electrical charges to toner. Accordingly, insufficient image density caused by a decrease in the transferability due to a reduction in the tone charge amount can be suppressed, if not prevented entirely.

As described above, the secondary transfer bias includes the superimposed bias that cyclically alternates between the bias in a transfer direction (a transfer-directional bias) that transfers a toner image from the image bearer onto the recording sheet and the bias in the opposite direction (the opposite-directional bias). Further, a duty is defined as a ratio of a time period of application of the opposite-directional bias with respect to one cycle of the secondary transfer bias applied. A bias with a duty greater than 50% is defined as a high-duty bias.

Figure 15A:
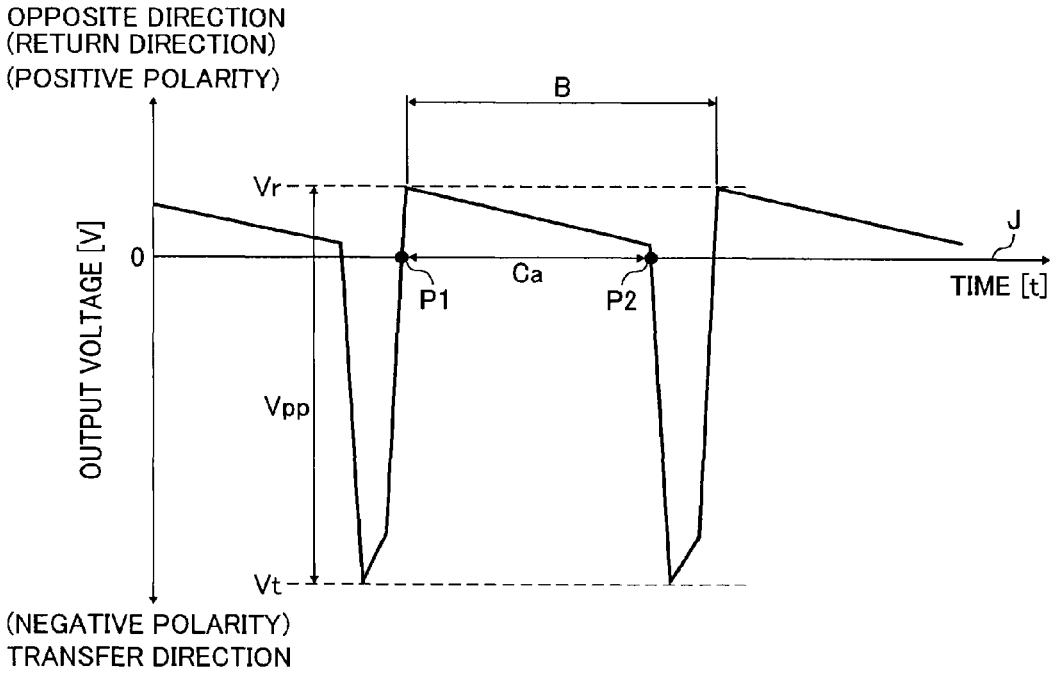
FIGS. 15A through 15C are schematic graphs of the waveform of FIG. 12B to describe a duty.

FIGS. 15A through 13C, and FIG. 12B are schematic graphs of waveforms. A description is provided of a duty referring to the drawings.

The alternating current (AC) bias which is the alternating current (AC) component included in the second transfer bias alternates between the bias that flows toward the transfer direction and the bias that flows toward the opposite direction of the transfer direction. In the present embodiment, the bias that flows toward the "transfer direction" refers to a transfer-directional bias having a negative polarity, and the bias that flows toward the "opposite direction" refers to an opposite-directional bias in the opposite direction of the transfer direction, having a positive polarity. The transfer-directional bias and the opposite-directional bias have polarities different from each other with a polarity switching baseline J, at which the voltage is 0 V, as the boundary therebetween. The time period of application of the opposite-directional bias in one cycle refers to a time period Ca from P1 to P2, in which the bias having a positive polarity that switches to an opposite polarity from 0 V is applied, as illustrated in FIG. 15A.

Figure 15B:
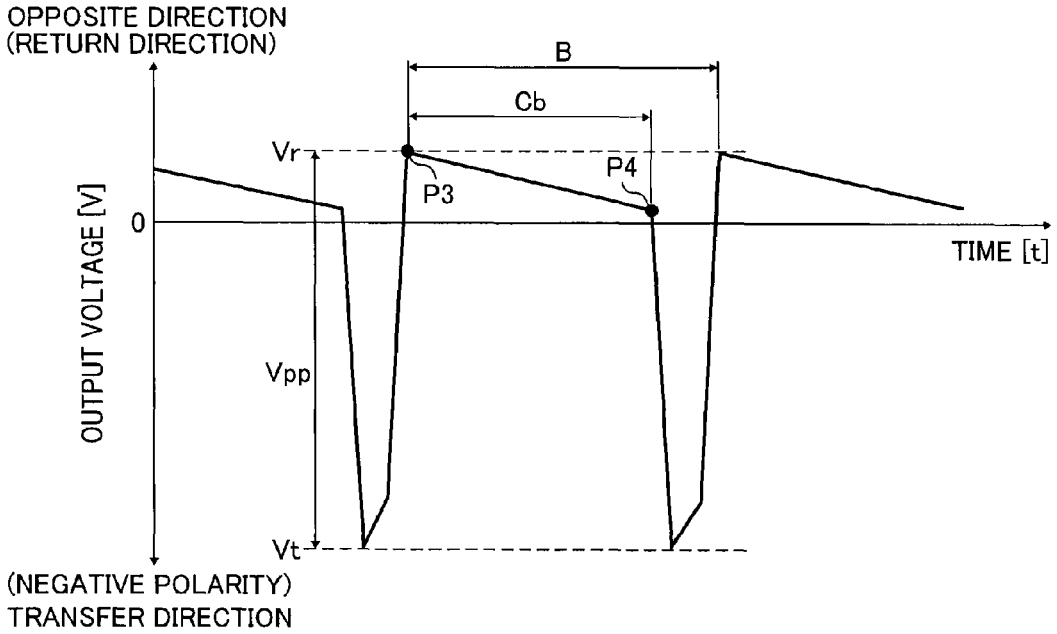
Figure 15C:
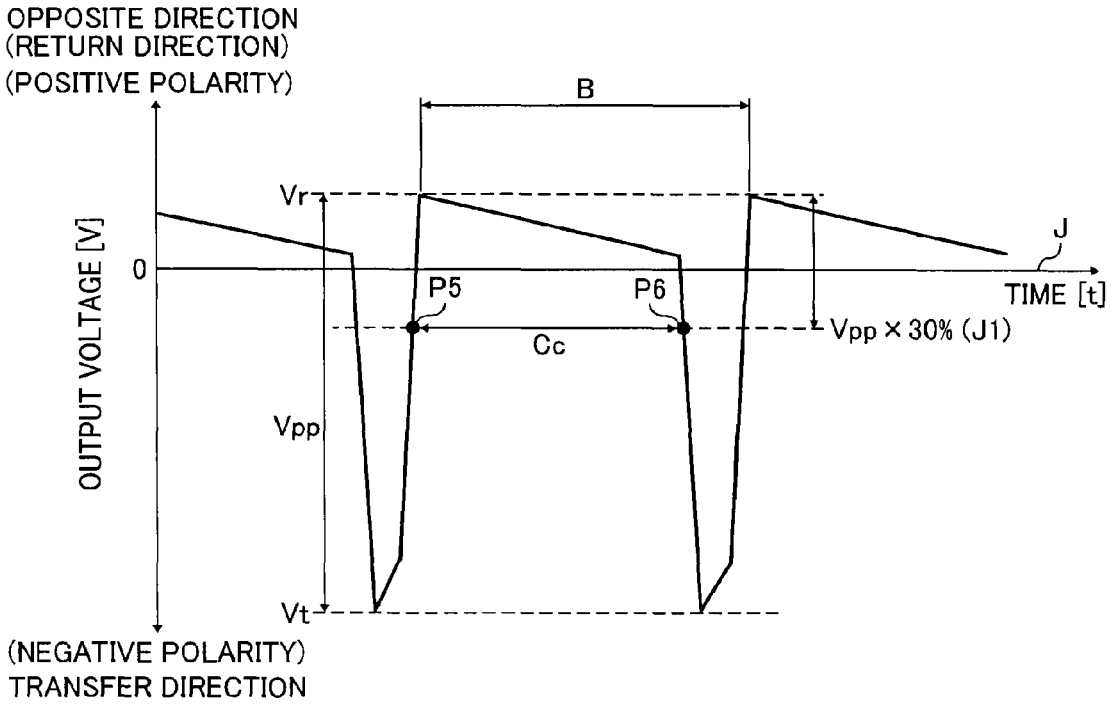
Figure 16A:
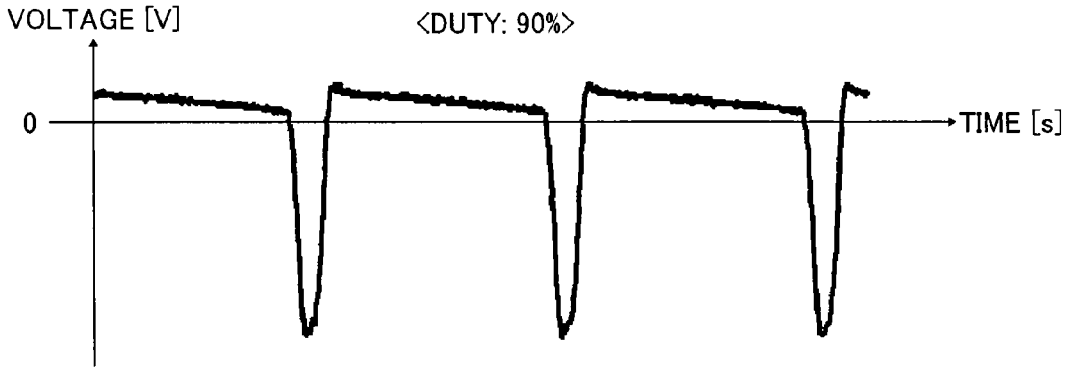
FIGS. 16A through 16E are graphs of waveforms used for tests.
Figure 16B:
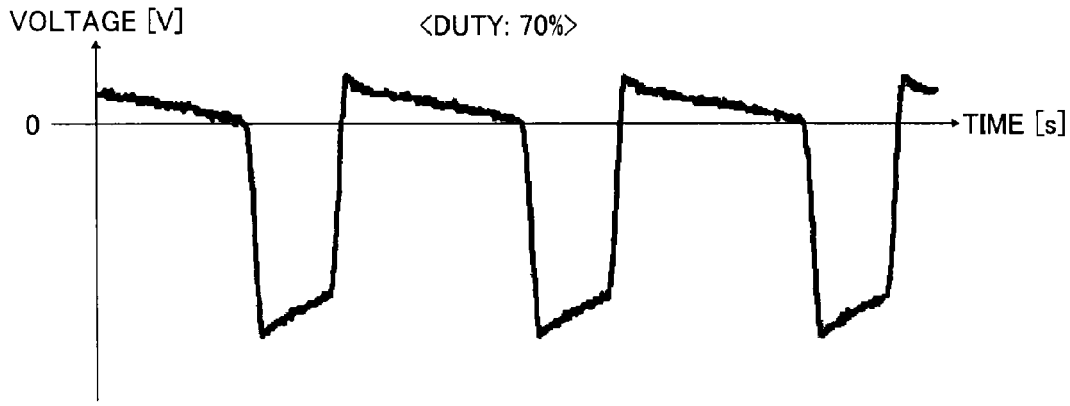
Figure 16C:
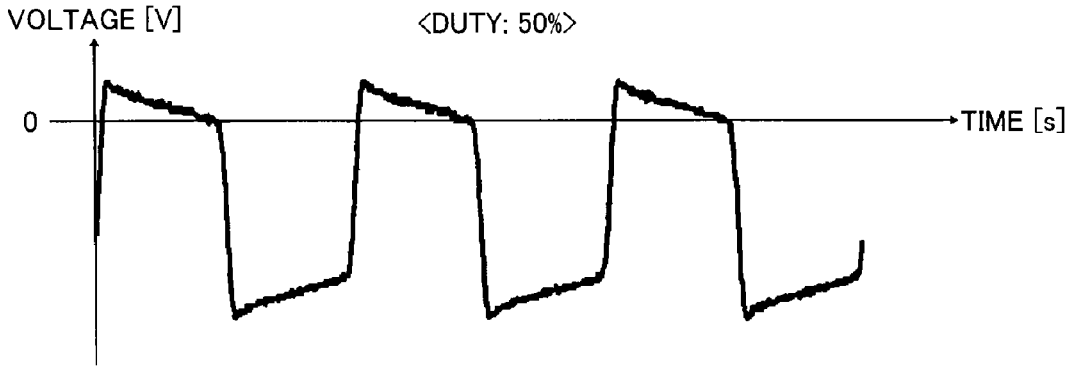
Figure 16D:
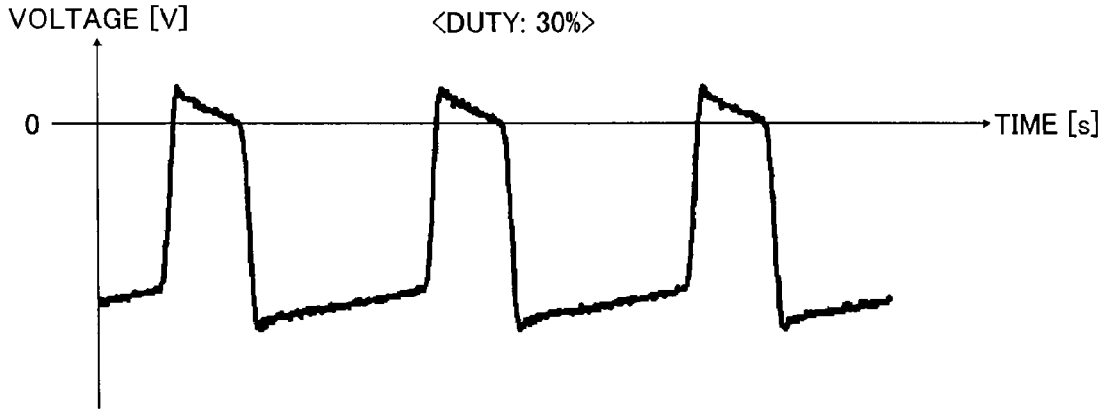
Figure 16E:
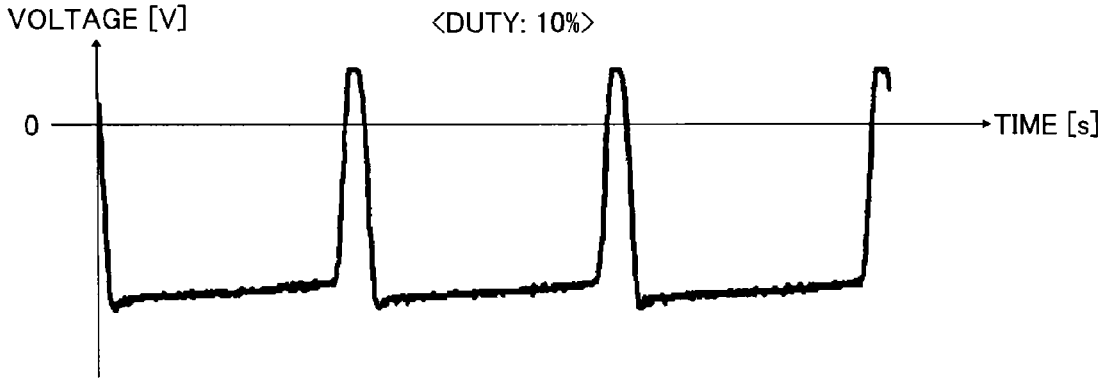

Referring to FIG. 15B, the time period of application of the opposite-directional bias in the one cycle refers to a time period Cb ranging from P3 to P4. P3 is when the bias reaches the opposite-directional peak voltage Vr, and P4 is when the bias starts to rise upward to the transfer-directional peak voltage Vt. Referring to FIG. 15C, the time period of application of the opposite-directional bias in the one cycle is a time period Cc from P5 to P6, which is on the opposite direction side of a baseline J1. In this case, this baseline J1 refers to a line at a position shifted from the opposite-directional peak voltage Vr to the transfer-directional peak voltage Vt in the transfer direction by 30% of Vpp.

Next, a description is provided of some tests performed by the present inventors.

(Test 1)

—Test Conditions—

Environment Conditions: 27° C./80%;

Type of recording sheet: Coated sheet, i.e., Mohawk Color Copy Gloss 270 gsm (457 mm×305 mm);

Process linear velocity: 630 mm/s;

Output image: Black half tone; and

Width of secondary transfer nip: 4 mm.

In some embodiments, the secondary transfer bias as described above may be applied for the transfer of normal paper and recycled paper.

FIGS. 16A through 16E are schematic graphs of waveforms, and FIG. 17 indicates the result of Test 1.

FIGS. 16A through 16E are conditions for the waveform of FIG. 12A, respectively illustrating images of waveforms output with a duty of 90%, 70%, 50%, 30%, and 10%. FIG. 17 indicates results of sensory evaluations on halftone images output with these waveforms. The images were evaluated as follows: The evaluations were graded on a five point scale of 1 to 5, in which higher grade, higher evaluation.

The "DUTY" in each of FIGS. 16A through 16E is defined by (Cb/B)×100(%) in FIG. 15B. That is, the duty refers to a ratio of a time period Cb from a point P3, at which the bias reaches the opposite-directional peak voltage Vr, to a point P4, at which the bias starts rising toward the transfer-directional peak voltage Vt, with respect to the total time period B of one cycle of the secondary transfer bias applied. It should be noted that the duty may be defined by (Ca/B)×100 (A) in FIG. 15A or by (Cc/B)×100(%) in FIG. 15C.

That is, grade 5 indicates that the density of the halftone image was sufficient. Grade 4 indicates that the density was slightly lower than that of Grade 5, but the density was good enough so as not to cause a problem, such as an image failure. Grade 3 indicates that the density was lower than that of Grade 4, and desired image quality to satisfy users was not obtained. Grade 2 indicates that the density was lower than that of Grade 3, and 1 indicates that the test image looked generally white or even whiter (less density). The acceptable image quality to satisfy users was 4 or above.

According to the results of Test 1 in FIG. 17, with a duty of 90% and 70%, the image density was graded as Grade 5. With a duty of 50%, the image density was graded as Grade 3, and with 30% and 10%, graded as Grade 1.

As described above, with a low duty of 10% (FIG. 16E) and 30% (FIG. 16D), the time period A of application of a negative voltage of the peak value Vt is longer than the time period C, which causes the overcharge of the toner image, resulting in a deterioration in the transferability. In contrast, with a high duty of 70% (FIG. 16B) and 90% (FIG. 16A), a time period A of application of a negative voltage with a peak value is short, thereby preventing the overcharge of the toner image, which upgrades the transferability.

Further, reversing polarities of Vr and Vt in the waveforms reliably prevents the overcharge. This is because, in this configuration with crossing 0 V, even when the recording sheet P is charged, the electric field is generated in a direction that prevents the injection of the charges.

As described above, in the present embodiment, to prevent the prenip electrical discharge and transfer failure so as to provide favorable images, the secondary-transfer second roller 36 is caused to be offset toward the upstream side in direction of conveyance of recording sheet, and the high-duty superimposed bias is employed as the secondary transfer bias. The high-duty bias refers to a bias with a duty greater than 50%, and more preferably greater than or equal to 70%.

(Test 2) In Test 2, the image evaluation was made when the values of the DC voltage (the DC component) and the AC voltage (the AC component) in the secondary transfer bias (the superimposed bias) were changed with the linear velocity varied. FIG. 18 indicates the evaluation results of Test 2. In FIG. 18, the linear velocities E1 and E2 are set to −E1 and −E2, which are reduced to 80% of the reference speed Ea.

—Test Conditions—

Environment Conditions: 27° C./80%;

Type of recording sheet: Coated sheet, i.e., Mohawk Color Copy Gloss 270 gsm (457 mm×305 mm);

Process linear velocity: 630 mm/s, which is a linear velocity (reference speed Ea) of 100%;

Output image: Solid image of a cyan (blue) color, and a halftone image of a cyan (blue) color;

Width of secondary transfer nip: 4 mm;

Environment conditions: 27° C./80%; and

Type of recording sheet: Coated sheet, i.e., Mohawk Color Copy Gloss 270 gsm (457 mm×305 mm).

In Test 2, the secondary transfer bias of the waveform illustrated in FIG. 12B is applied.

With Vt of −4.8 kV, Vr of 1.2 kV, and Voff (the DC component) of −1.8 kV in the secondary transfer bias output, the DC component has a value of 100% in FIG. 18.

With Vave of 0.08 kV, and Vpp (the AC component) of 6.0 kV, the AC component has a value of 100% in FIG. 18.

With a duration A of peak Vt of 0.10 ms and a cycle B of a waveform of 0.66 ms, the duty of the waveform is 85%.

—Bias Conditions—

In Condition 1, the values of the AC component (the AC voltage) and the DC component (the DC voltage) are the same as at the reference speed Ea.

In Condition 2, the value of the AC component (the AC voltage) is the same as at the reference speed Ea, and the value of the DC component (the DC voltage) is magnified by the ratio of the linear velocity to the reference speed Ea.

In Condition 3, the value of the AC component (the AC voltage) is magnified by the ratio of the linear velocity to the reference speed Ea, and the value of the DC component (the DC voltage) is the same as at the reference speed Ea. In Condition 4, the values of the AC component (the AC voltage) and the DC component (the DC voltage) are magnified by the ratio of the linear velocity to the reference speed Ea.

In Test 2, sensory evaluations were performed on images under Conditions 1 through 4. The images were evaluated as follows: The evaluations were graded on four levels, such as "EXCELLENT", "GOOD", "FAIR", and "POOR".

EXCELLENT: the density of the image was sufficient.

GOOD: the density was slightly lower than that of EXCELLENT, but the density was good enough so as not to cause a problem, such as a image failure.

FAIR: the density was lower than that of GOOD, and permissible image quality to satisfy users was obtained.

POOR: the density was lower than that of GOOD, and permissible image quality to satisfy users was obtained.

—Evaluation Results—

The results of Condition 1 indicate that the transferability is worse in a halftone image than a solid image, due to an excessive transfer of a toner image.

The results of Condition 2 indicate that the transferability is good in both the solid image and the halftone image.

The results of Condition 3 indicate that the transferability is poor in the halftone image due to an excessive transfer of a toner image.

The results of Condition 4 indicate that the transferability is deteriorated in the solid image, due to the insufficient amount of the transfer bias.

From the results described above, when the process linear velocity is varied, the optimal values of the AC component (the AC voltage) and the DC component (the DC voltage) are the same value as at the reference speed Ea and the value magnified by the ratio of the linear velocity to the reference speed Ea, respectively.

[Variation 1]

(Test 3)

A bias setting at a process linear velocity of 80% and evaluations of images (a solid image and a halftone image) were performed under Condition 5 below.

—Bias Conditions—

In Condition 5, the AC component and the DC component of the secondary transfer bias are 100% and 70% respectively. Other conditions and how to perform the sensory evaluations are the same as in Test 2.

—Evaluation Results—

The evaluation results for a solid image (blue) and a halftone image (blue) are fair and excellent respectively. In variation 1, with the process linear velocity set as the linear velocities −E1 and −E2 lower than the reference speed Ea, every portion of a recording sheet P takes more time in passing through a secondary transfer nip N, thereby increasing the time period of charging toner, resulting in the overcharge, that is, the excessive transfer of a toner image.

In Condition 5, the ratio (70%) of the DC component (the DC voltage) at lower linear velocities with respect to the DC component (the DC voltage) at the reference speed Ea is lower than the ratio (80%) of the lower linear velocities with respect to the reference speed Ea in Test 2.

In such a manner, reducing the ratio of the DC component (the DC voltage) at the lower linear velocities with respect to the DC component at the reference speed Ea gives a test result of "EXCELLENT" for the halftone image. Thus, decreasing the value of the DC component (the DC voltage) at lower linear velocities in such a manner reliably prevents the excessive transfer.

It should be noted that in some embodiment, an operator operates the operation panel 408 in FIG. 13 to change the amount of the DC component (the value of the DC voltage) at lower linear velocities.

The "value of the DC component at lower linear velocities" set by the operation panel (setting device) 408 is preferably stored in the ROM 302. The controller 300 controls, based on the "value of the DC component at lower linear velocities" stored in the ROM 302, the power source 39 to output the secondary transfer bias including the DC component (the DC voltage) of the same value as the "value of the DC component at lower linear velocities".

For example, users decrease the "value of the DC component at lower linear velocities" (for example, to a value of 70%) when outputting an image with a lower density, such as a halftone image.

In contrast, when outputting a high-density image, such as a solid image, users increases the "value of the DC component at lower linear velocities" (for example, to a value of 80%).

Changing the "value of the DC component at lower linear velocities" allows a successful transfer of toner images with an appropriate level of bias according to the density of images to be output.

That is, the image forming apparatus 100 is configured to change the value of the DC voltage in the superimposed bias according to the image density of images to be output. The controller 300 is configured to control the power source 39 to decrease the value of the DC voltage in the superimposed bias as a lower-density image is output.

[Variation 2]

In the above-described embodiment (Condition 2) and Variation 1 (Condition 5), the value of the AC component (the AC voltage) is fixed (to 100%), irrespective of the process linear velocity. In some embodiment, the values of the DC component and the AC component are variable according to the process linear velocity.

In this case, the waveform of the superimposed bias output from the power source 39 satisfies the following relations:

The value of Vr at the linear velocities −E1 and −E2 (80% of the reference speed Ea) lower than the reference speed Ea is shifted to the direction opposite to the transfer direction, compared to the value of Vr at the reference speed Ea (100% of the reference speed Ea).

The "transfer direction" refers to a direction, in which a normally charged toner moves from the intermediate transfer belt 31 to a recording sheet P.

For example, taking an example in FIG. 12B, when the value of Vr at a reference speed Ea of 100% is +1.2 kV, the value of Vr at lower linear velocities −E1 and −E2 of 80% is larger than +1.2 kV.

When the linear velocities are lower than the reference speed Ea, the time period of the recording sheet's passing through the secondary transfer nip N increases. Accordingly, shifting the value of Vr in the opposite direction of the transfer direction reduces the amount of the electrical charges injected to toner, compared to when the linear velocities are the reference speed Ea. Such a configuration reliably prevents the overcharge and excessive transfer of toner when the linear velocities are lower than the reference speed Ea.

The value of the AC component may be variable according to the process linear velocity within the range that satisfies the conditions described above. For example, when the value of the AC component (the value of a peak-to-peak voltage Vpp) is 100% at a process velocity of 100%, the value of the AC component at a process speed of 80% may be set to 90% or 95%.

Embodiment 2

In the present embodiment, the intermediate transfer belt 31 is made of an elastic material to ensure the transferability of a recording sheet P having an uneven surface. After the toner of the four colors are primarily transferred onto the intermediate transfer belt 31, the four-color composite toner image is transferred secondarily from the intermediate transfer belt 31 onto the recording sheet P. The intermediate transfer belt 31 includes a base layer 310, an elastic layer 311, and a coating layer 312, which are laminated in this recited order from the inner side. The base layer is made of resins such as polyimide and polyamide-imide with a thickness of 50 μm to 100 μm. The elastic layer 311 is made of an acrylic rubber. The coating layer 312 has releasability. The elastic layer 311 typically has a thickness of 100 μm to 1 mm. To prevent transfer failure, a pressing force adequate for the secondary transfer is applied to the intermediate transfer belt 31 according to the property of rubber of the intermediate transfer belt 31. This provides a favorable transferability of toner even in concave portions of the unevenness of the recording sheet P. In the present embodiment, the intermediate transfer belt 31 made of polyimide resin (PI) is employed.

When the elastic layer with such a configuration is used as the intermediate transfer belt 31, a high transfer voltage is applied to the elastic layer 311 for a successful secondary transfer. For examples, a plurality of pressing devices as a secondary transfer pressing device are employed to vary a transfer pressure with the type of the recording sheet P, such as the degree of an unevenness and the thickness.

However, applying an adequate amount of transfer pressure causes the recording sheet P to have a high adhesion property relative to the intermediate transfer belt 31, thereby interfering with the separation of the recording sheet P, which has passed through the secondary transfer nip N, from the intermediate transfer belt 31. That is, a separation failure occurs. Such a failure is pronounced in the roller scheme that employs a secondary-transfer second roller 36. Therefore, it is preferable for the image forming apparatus to combine with a secondary transfer unit 41 of the secondary transfer belt scheme according to the first embodiment to attain both a high ability of separation of the recording sheet P from the inter mediatetransfer belt 31 and a high transferability of the toner images onto the recording sheet P.

Using the PI belt as the intermediate transfer belt 31 tends to lower the resistance of belt due to time degradation of the P1 belt. In such a case as well, the value of the DC component is changed when changing the process linear velocity is changed in a state that the superimposed bias of a duty greater than 50% is applied. The power source 39 outputs the secondary transfer bias including the DC voltage of a decreased value, without changing the value of AC voltage, when the process linear velocity is lower than the reference speed Ea. This prevents an excessive transfer of toner image.

As it is apparent from the test that an elastic intermediate transfer belt 31 is weaker in the prenip electrical discharge than the PI belt.

Accordingly, a prenip in the elastic intermediate transfer belt 31 is formed to be wider than the PI belt does. Thus, in the present embodiment, the length of the prenip is 5.2 mm, which is longer than those in the first embodiment through the fourth embodiment. In this case, the "length" refers to a length along the direction b of conveyance of the recording sheet.

As described above, as a large size of prenip is formed in the elastic intermediate transfer belt 31, the length of the secondary transfer nip N is increased. This causes toner to be easily overcharged. Therefore, a high-duty (with a duty greater than 50%) superimposed bias is preferably applied as the secondary transfer bias when an elastic belt is used for the intermediate transfer belt 31. With this configuration, higher ability of separation of and transferability onto the recording sheet P is secured, preventing abnormal images from being generated due to the overcharge of toner, as compared to using the PI belt for the intermediate transfer belt 31.

The intermediate transfer belt 31 made of an elastic material can be employed as the elastic belt having particles 313 as illustrated in FIGS. 3B and 3C. As such an elastic belt with an upper most layer (i.e., the elastic layer 311) in which particles 313 are dispersed is used, a contact area of a belt surface with toner in the secondary transfer nip N is reduced. With this configuration, a contact area of the belt surface with the toner in the secondary transfer nip can be reduced, and hence the ability of separation of the toner from the belt surface can be enhanced. The transfer rate can be enhanced.

However, when the secondary transfer current flows concentrically between the insulating particles 313 which are arranged regularly, the electrical charges having an opposite polarity get injected easily to the toner, which may overcharge the toner. As a result, even when the particles 313 are dispersed to enhance the transfer rate, the secondary transfer rate may decrease.

In view of this, the secondary transfer bias with a high duty (with a duty greater than 50%) is applied to reliably enhance the secondary transfer rate by the particles 313. Further, when the process linear velocity is lower than the reference speed Ea with the superimposed bias of a duty greater than 50% applied, the power source 39 outputs the secondary transfer bias including the DC voltage of a decreased value, without changing the value of AC voltage. This prevents the excessive transfer of a toner image.

As the particles 313, particles capable of getting oppositely charged to the normal charging polarity of the toner are employed. According to the present embodiment, the particles 313 are constituted of melamine resin particles having a positive charging property. With this configuration, electric charges of the particles 313 prevents concentration of the secondary transfer current between the particles, hence further reducing the injection of opposite electrical charges to the toner.

Alternatively, in some embodiments, particles having charge property of the same charge polarity as the normal charge polarity of the toner are used as the particles 313. For example, silicone resin particles having a negative charge property (i.e., Tospearl (registered trademark)) may be used in the image forming apparatus according to the present embodiment.

With a sponge roller used for the secondary-transfer first roller 33 as the repulsive roller, resistance unevenness is more likely to occur than a rubber roller does, resulting in an excessive transfer. In such a case as well, the value of the DC component is changed when changing the process linear velocity is changed in a state that the superimposed bias of a duty greater than 50% is applied. The power source 39 outputs the secondary transfer bias including the DC voltage of a decreased value, without changing the value of AC voltage, when the process linear velocity is lower than the reference speed Ea. This prevents an excessive transfer of toner image.

In the present embodiment, the PI belt is used for the secondary transfer belt 404 as the secondary transfer member. Using the PI belt for the secondary transfer belt 404 in such a manner easily causes resistance unevenness, compared to using the secondary transfer roller as a roller of the transfer device. However, in such a case as well, with the superimposed bias of a duty greater than 50% applied, the value of the DC component (the DC voltage) is changed while changing the process linear velocity. The power source 39 outputs the secondary transfer bias including the DC voltage of a decreased value, without changing the value of AC voltage, when the process linear velocity is lower than the reference speed Ea. This prevents an excessive transfer of toner image.

Figure 19:
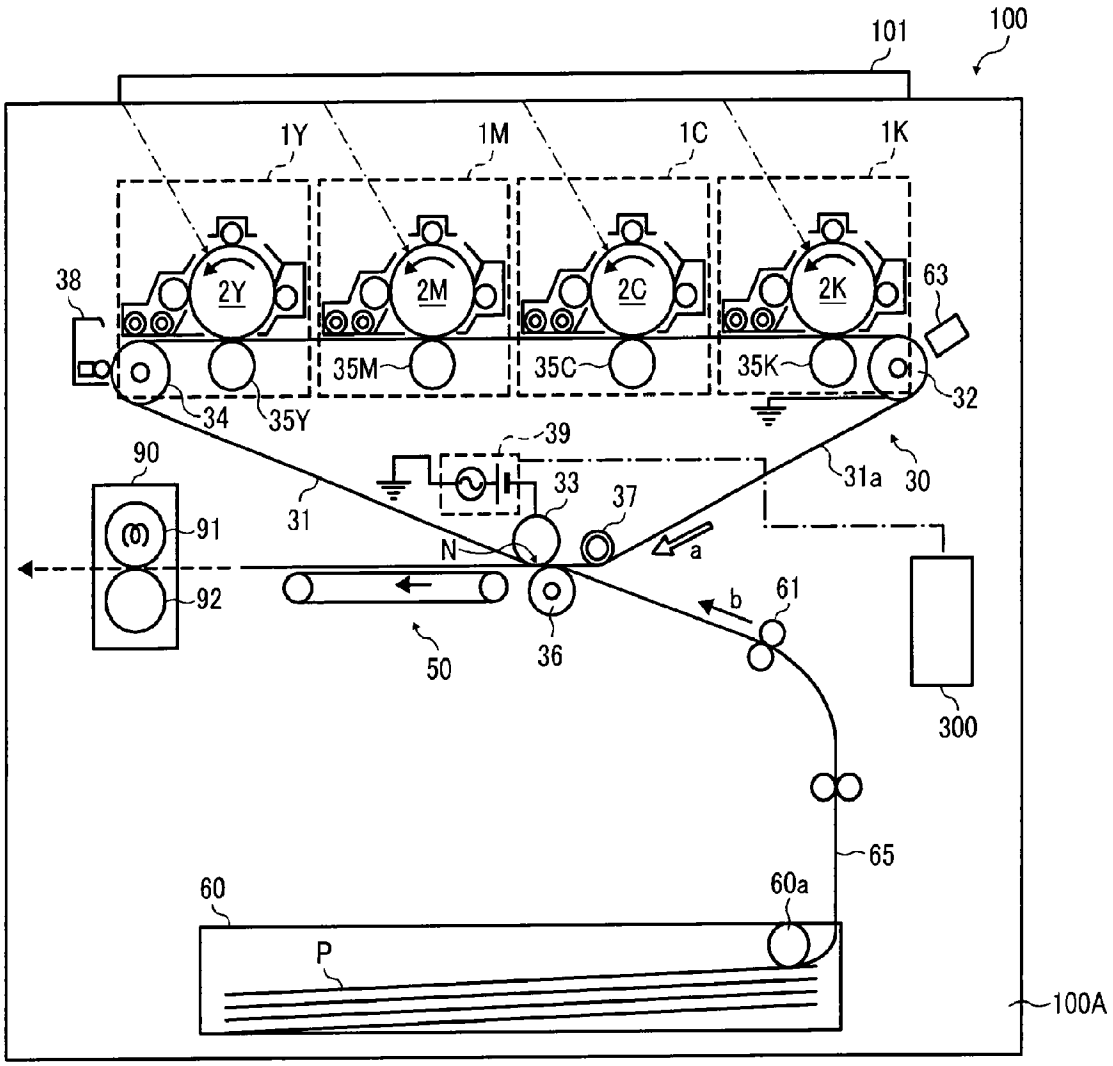
FIG. 19 is a schematic diagram of an image forming apparatus according to another embodiment of the present disclosure.

The image forming apparatus 100 of the present embodiments employs the secondary transfer unit 41 including the secondary-transfer second roller 36 and the secondary transfer belt 404 as the transfer device. Alternatively, instead of the belt method, the image forming apparatus 100 may employ a roller method in which the secondary-transfer second roller 36 directly contacts and separates from the intermediate transfer belt 31 as illustrated in FIG. 19. The secondary-transfer second roller 36 can be also referred to as a secondary-transfer opposed roller. The inter mediate transfer belt 31 is interposed between the secondary-transfer first roller 33 and the secondary-transfer second roller 36, thereby forming a secondary transfer nip N. The secondary transfer nip N is referred to as a transfer portion. In this case as well, the secondary transfer bias is output from the power source 39 to the secondary-transfer first roller 33. Further, the secondary-transfer second roller 36 is electrically ground. With this configuration, a secondary transfer electrical field is formed in the secondary transfer nip N between the secondary-transfer first roller 33 and the secondary-transfer second roller 36 so that the toner having a negative polarity is transferred electrostatically from the secondary-transfer first roller 33 to the secondary-transfer second roller 36. A transfer bias may be applied to the secondary-transfer second roller 36. A conveyor belt 50 is disposed between the secondary-transfer second roller 36 and the fixing device 90 so that the recording sheet P is reliably conveyed to the fixing device 90 after the secondary transfer.

Using a belt for transfer has an advantageous effect in ease of separation of a thin paper. However, the electrical discharge is more likely to occur in such thin paper. Therefore, the secondary-transfer second roller 36 is advantageously shifted toward the upstream side in the direction of convey of the recording sheet to prevent the occurrence of the electrical discharge in thin paper as well.

That is, when transferring a toner image from the intermediate transfer belt 31 onto the recording sheet P, the power source 39 outputs the secondary transfer bias that cyclically alternates the transfer-directional voltage and the return-directional (opposite-directional) voltage in an opposite direction of the transfer direction. With the transfer-directional voltage output, the toner image is transferred from the intermediate transfer belt 31 to the recording sheet P. In the waveform of such a secondary transfer bias, the output voltage may alternate the voltage between the transfer-directional voltage and the return-directional voltage in the polarity on the return direction side of 0 V when the transfer-directional voltage is Vr and the return-directional voltage is Vt.

Figure 20:
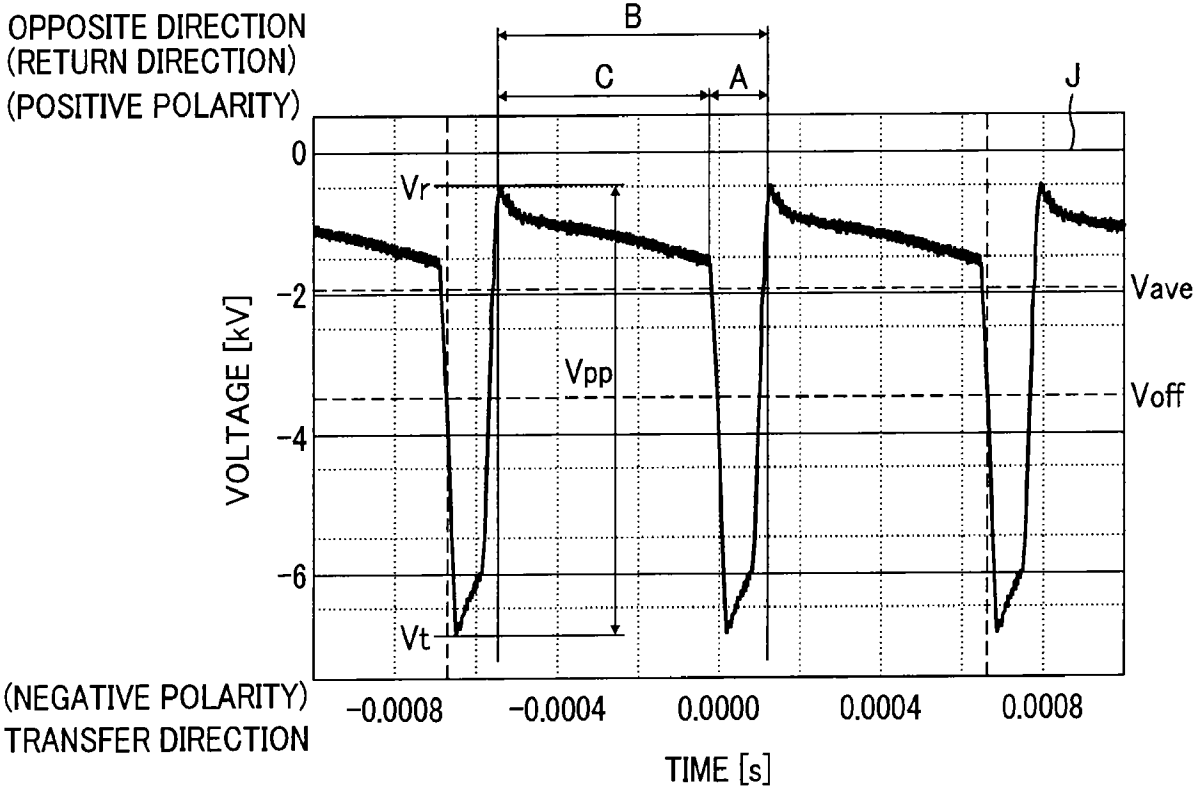
FIG. 20 is a waveform of a bias with a high duty output from the transfer bias power source according to another embodiment of the present disclosure.

According to the present embodiments, and variations 1 and 2, when the linear velocities E1 and E2 are the reference speed Ea or the liner velocities −E1 and −E2, the secondary transfer bias output from the power source 39 has the waveform as illustrated in FIGS. 12, 15, and 16, that rises and falls across 0 V between the peak value Vr of a positive voltage and the peak value Vt of a negative voltage. However, the waveform is not limited to such a form. For example, in some embodiments, the peak value Vr of the return-directional bias is set toward the transfer direction side (a negative bias side) than 0 V as illustrated in FIG. 20. The waveform rises and falls between the peak value Vr and the peak value Vt in the negative voltage area. In this case, with the duty greater than 50%, overcharging the toner is prevented, thus preventing the generation of abnormal images.

Alternatively, in some embodiments, the transfer bias does not alternate the polarity between positive and negative as illustrated in FIG. 20 at the reference speed Ea, and the transfer bias alternates the polarity between positive and negative as illustrated in FIGS. 12, 15, and 16 at the linear velocities −E1 and −E2.

In the present embodiments as described above, the amount of the secondary transfer nip N as the transfer portion is increased by forming a prenip at the upstream side in direction b of conveyance of the recording sheet. Due to the increased secondary transfer nip N, toner is overcharged, thereby generating the electrical discharge. Such an electrical discharge also occurs in the secondary transfer nip N, which has increased toward the downstream side in the direction b of conveyance of the recording sheet. Thus, when the transfer bias (the secondary transfer bias) with a duty of 50% or greater is applied, the configuration with the secondary transfer nip N expanded (increased) downstream in the direction of conveyance of recording sheet is applicable, in which the front surface 31*a* of the intermediate transfer belt 31 contacts the outer circumferential surface 36*a* of the secondary-transfer second roller 36 or the outer circumferential surface 404*a* of the secondary transfer belt 404 as the transfer device. In such a case as well, applying a transfer bias (the secondary transfer bias) with a duty greater than 50% prevents the overcharge of toner, thereby preventing the generation of abnormal images.

In the embodiments described above, a description was provided of an image forming apparatus that employs the intermediate transfer method by which an image is transferred from the intermediate transfer belt 31 onto the recording sheet P. The configuration according to the present embodiments is applicable to an image forming apparatus that employs a direct transfer method in which an image is transferred from an image bearer, such as a photoconductive drum and a photoconductive belt, onto the recording sheet P. In addition, a transfer device that employs a charging method in which no transfer nip is formed may be used.

In the image forming apparatus according to the present embodiments described above, the recording sheet P passes through the secondary transfer nip N (the transfer portion) in a horizontal direction. Alternatively, in some embodiments, the image forming apparatus includes a configuration in which the recording sheet P passes through the transfer portion upward, downward, obliquely upward, or obliquely downward.

Although the embodiments of the present disclosure have been described above, the present disclosure is not limited to the embodiments described above, but a variety of modifications can naturally be made within the scope of the present disclosure.

The image forming apparatus of the present disclosure is not limited to a printer. The image forming apparatus includes, but is not limited to, a copier, a printer, a facsimile machine, and a multi-functional system including a combination thereof.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus, comprising:

an image bearer configured to bear a toner image;

a transfer device disposed opposing to the image bearer; and a transfer bias power source configured to output a transfer bias to a transfer portion where the transfer device contacts the image bearer so as to transfer the toner image onto a recording medium, the transfer bias being a superimposed bias, in which an alternating current voltage is superimposed on a direct current voltage, that cyclically alternates between a transfer-directional bias to transfer the toner image from the image bearer onto the recording medium and an opposite-directional bias in an opposite direction of the transfer direction, wherein a ratio of a time period of application of the opposite-directional bias to a total time period of one cycle of the output transfer bias is greater than 50%, wherein the transfer bias power source changes a value of the direct current voltage in the superimposed bias according to a linear velocity of the image bearer; and wherein the transfer bias includes a transfer-directional peak voltage and an opposite-directional peak voltage, the opposite-directional peak voltage being shifted from a predetermined voltage towards an opposite direction side when the linear velocity of the image bearer is lower.

2. The image forming apparatus according to claim 1, wherein the transfer bias power source changes the value of the direct current voltage without changing a value of the alternating current voltage in the superimposed bias when the linear velocity of the image bearer changes.

3. The image forming apparatus according to claim 1, wherein the transfer bias power source reduces an absolute value of the direct current voltage as the linear velocity of the image bearer is lower.

4. The image forming apparatus according to claim 3, wherein a ratio of the direct current voltage at the lower linear velocity to the direct current voltage at a predetermined velocity is smaller than a ratio of the lower linear velocity to the predetermined velocity.

5. The image forming apparatus according to claim 1, wherein the image bearer is an intermediate transfer belt including a plurality of layers.

6. The image forming apparatus according to claim 1, wherein the image bearer is an intermediate transfer belt including an elastic layer.

7. The image forming apparatus according to claim 1, wherein the image bearer is an intermediate transfer belt made of polyimide resin.

8. The image forming apparatus according to claim 1, further comprising:

an opposed roller disposed opposing to the transfer device via the image bearer in the transfer portion, wherein the opposed roller is a foamed roller.

9. The image forming apparatus according to claim 1, wherein the transfer device is a secondary transfer belt disposed in contact with the image bearer and rotatably wound around a plurality of rollers.

10. The image forming apparatus according to claim 9, wherein the secondary transfer belt is made of polyimide resin.

11. The image forming apparatus according to claim 1, wherein the transfer bias power source changes the value of the direct current voltage in the superimposed bias according to an image density of the toner image.

12. The image forming apparatus according to claim 11, wherein the transfer bias power source reduces the absolute value of the direct current voltage in the superimposed bias as the image density is lower.

13. The image forming apparatus according to claim 1, wherein a surface of the image bearer contacts an outer circumferential surface of the transfer device at at least one of an upstream side and a downstream side of the transfer portion.

14. The image forming apparatus according to claim 1, wherein the transfer-directional bias and the opposite-directional bias have polarities different from each other with the polarity switching baseline as a boundary, and wherein the time period of application of the opposite-directional bias in the one cycle is a time period of application of the transfer bias having an opposite polarity to a polarity of the transfer-directional bias.

15. The image forming apparatus according to claim 1, wherein the time period of application of the opposite-directional bias in the one cycle is a time period ranging from when the transfer bias reaches an opposite-directional peak voltage to when the transfer bias starts to fall toward a transfer-directional peak voltage.

16. The image forming apparatus according to claim 1, wherein the transfer-directional bias and the opposite-directional bias have polarities different from each other with the polarity switching baseline as a boundary, and wherein the time period of application of the opposite-directional bias in the one cycle is a time period of application of a bias in the opposite direction with a baseline at a position shifted, relative to the predetermined voltage, from an opposite-directional peak voltage to a transfer-directional peak voltage by 30% of a peak-to-peak voltage, as a boundary.

17. The image forming apparatus according to claim 1, wherein a polarity of the transfer bias is constant.

18. The image forming apparatus according to claim 1, wherein a polarity of the transfer bias alternatively changes between positive and negative.

19. An image forming apparatus, comprising:

an image bearer configured to bear a toner image;

a transfer device disposed opposing to the image bearer;

a transfer bias power source configured to output a transfer bias to a transfer portion where the transfer device contacts the image bearer so as to transfer the toner image onto a recording medium, the transfer bias cyclically alternating between a transfer-directional bias to transfer the toner image from the image bearer onto the recording medium and an opposite-directional bias in an opposite direction of the transfer direction, a ratio of a time period of application of the opposite-directional bias to a total time period of one cycle of the transfer bias being greater than 50%, the transfer bias including a transfer-directional peak voltage and an opposite-directional peak voltage; and a controller to change the transfer bias output from the transfer bias power source according to a linear velocity of the image bearer, wherein the opposite-directional peak voltage is a first voltage when the linear velocity is a first velocity, and wherein the opposite-directional peak voltage is a second voltage that is shifted towards an opposite-directional side relative to the first voltage when the linear velocity is a second velocity lower than the first velocity.

20. The image forming apparatus according to claim 19, wherein a polarity of the transfer bias cyclically alternates between positive and negative.

* * * * *